US009044949B2

(12) United States Patent
Taira

(10) Patent No.: US 9,044,949 B2
(45) Date of Patent: Jun. 2, 2015

(54) LIQUID EJECTION APPARATUS AND HUMID-AIR SUPPLY METHOD

(75) Inventor: Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/544,682

(22) Filed: Jul. 9, 2012

(65) Prior Publication Data

US 2013/0010028 A1 Jan. 10, 2013

(30) Foreign Application Priority Data

Jul. 8, 2011 (JP) ..... 2011-151787

(51) Int. Cl.
*B41J 2/165* (2006.01)

(52) U.S. Cl.
CPC ..... *B41J 2/165* (2013.01); *B41J 2/16588* (2013.01); *B41J 2/16532* (2013.01); *B41J 2/16505* (2013.01)

(58) Field of Classification Search
None
See application file for complete search history.

(56) References Cited

U.S. PATENT DOCUMENTS

| | | | | |
|---|---|---|---|---|
| 5,929,877 | A * | 7/1999 | Hetzer et al. | 347/28 |
| 2005/0168517 | A1 | 8/2005 | Usuda | |
| 2005/0237357 | A1 | 10/2005 | Usuda | |
| 2007/0146407 | A1 | 6/2007 | Hiraoka | |
| 2009/0096830 | A1 | 4/2009 | Shimazaki | |
| 2011/0109690 | A1 | 5/2011 | Kida et al. | |
| 2011/0242204 | A1 * | 10/2011 | Shinoda | 347/29 |
| 2012/0162311 | A1 * | 6/2012 | Taira | 347/30 |

FOREIGN PATENT DOCUMENTS

| | | | |
|---|---|---|---|
| CN | 1689817 | A | 11/2005 |
| JP | H07186405 | A | 7/1995 |
| JP | H09267469 | A | 10/1997 |
| JP | 2005-212138 | A | 8/2005 |
| JP | 2005212138 | A | 8/2005 |
| JP | 2008213358 | A | 9/2008 |
| JP | 2009101594 | A | 5/2009 |

OTHER PUBLICATIONS

European Patent Office, Extended European Search Report for European Patent Application No. 12175095.4 (counterpart to above-captioned patent application), mailed Oct. 23, 2013.

(Continued)

*Primary Examiner* — Alejandro Valencia
(74) *Attorney, Agent, or Firm* — Baker Botts L.L.P.

(57) ABSTRACT

A liquid ejection apparatus, including: a head having an ejection face having at least one ejection opening for ejecting liquid; a sealing mechanism configured to selectively establish one of a sealing state in which the sealing mechanism seals an ejection space and an open state in which the sealing mechanism does not seal the ejection space; an air introduction opening configured to open in an area that faces the ejection space in the sealing state; a humid air supplier configured to supply a humid air from the air introduction opening to the ejection space in the sealing state; a cleaner configured to clean the liquid contacting at least a part of an area of the head and the sealing mechanism, the area facing the ejection space; and a controller configured to control the cleaner to clean the liquid before the supply of the humid air supplier.

17 Claims, 12 Drawing Sheets

(56) References Cited

OTHER PUBLICATIONS

State Intellectual Property Office of the People'S Republic of China, Notification of First Office Action for Chinese Patent Application No. 201210231688.5 (counterpart to above-captioned patent application), mailed Mar. 3, 2014.

Japan Patent Office; Notification of Reasons for Rejection issued for Japanese Patent Application No. 2011-151787 (foreign counterpart of above-captioned patent application), mailed Jan. 27, 2015.

* cited by examiner

LIQUID EJECTION APPARATUS AND HUMID-AIR SUPPLY METHOD

CROSS REFERENCE TO RELATED APPLICATION

The present application claims priority from Japanese Patent Application No. 2011-151787, which was filed on Jul. 8, 2011, the disclosure of which is herein incorporated by reference in its entirety.

BACKGROUND OF THE INVENTION

1. Field of the Invention

The present invention relates to a liquid ejection apparatus for ejecting liquid such as ink and a humid-air supply method for the liquid ejection apparatus.

2. Description of the Related Art

A liquid ejection apparatus includes a head having an ejection face that has ejection openings through which liquid such as ink is ejected. If the liquid is not ejected from the ejection openings for a long time, a viscosity of the liquid near the ejection openings increases due to its vaporization, which may cause clogging of the ejection openings. The following technique is known as a technique for suppressing the clogging of the ejection openings, for example.

In this technique, the ejection face is covered with a recessed cap (a capping portion), thereby forming an ejection space isolated from an outside space. An air-conditioning equipment (a humid air supplier) having an air channel including an air introduction opening and an air outlet opening formed in the cap humidifies the ejection space by supplying a humid air from the air introduction opening into the ejection space and discharging an air in the ejection space from the air outlet opening. As a result, the vaporization of the liquid near the ejection openings is suppressed, which prevents the clogging of the ejection openings.

SUMMARY OF THE INVENTION

Incidentally, when the liquid ejected from the head contacts a component such as the cap and the ejection face at its area facing the ejection space, an amount of water content of the liquid contacting the component decreases due to drying with passage of time. If the humid air is supplied into the ejection space in a state in which the liquid whose water content has been decreased adheres to the area facing the ejection space, the remaining liquid content functions as a drying agent and absorbs water content of the humid air, making it impossible to speedily humidify the ejection space.

This invention has been developed to provide a liquid ejection apparatus and a humid-air supply method therefor capable of speedily humidifying an ejection space facing an ejection face of a head.

The present invention provides a liquid ejection apparatus, comprising: a liquid ejection head having an ejection face that has at least one ejection opening through which the liquid ejection head ejects liquid for forming an image on a recording medium, an ejection space being defined so as to face the ejection face; a sealing mechanism configured to selectively establish one of (i) a sealing state in which the sealing mechanism seals the ejection space from an outside space and (ii) an open state in which the sealing mechanism does not seal the ejection space from the outside space; an air introduction opening configured to open in an area that faces the ejection space when the sealing mechanism is in the sealing state; a humid air supplier configured to supply a humid air from the air introduction opening to the ejection space in the sealing state; a cleaner configured to clean the liquid contacting at least a part of an area of the liquid ejection head and the sealing mechanism, the area facing the ejection space; and a controller configured to control the cleaner to clean the liquid before the supply of the humid air supplier.

The present invention also provides a humid-air supply method for a liquid ejection apparatus including: a liquid ejection head having an ejection face that has at least one ejection opening through which the liquid ejection head ejects liquid for forming an image on a recording medium, an ejection space being defined so as to face the ejection face; and a sealing mechanism configured to selectively establish one of (i) a sealing state in which the sealing mechanism seals the ejection space from an outside space and (ii) an open state in which the sealing mechanism does not seal the ejection space from the outside space, the humid-air supply method comprising: a cleaning step of cleaning the liquid contacting at least a part of an area of the liquid ejection head and the sealing mechanism; and a supply step, after the cleaning step, of supplying a humid air from an air introduction opening configured to open in an area that faces the ejection space when the sealing mechanism is in the sealing state.

In the liquid ejection apparatus and method described above, the liquid having contacted the liquid ejection head and the sealing mechanism at the area facing the ejection space is cleaned and removed before the humid air is supplied into the ejection space, enabling speedy humidification of the ejection space.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIGS. 6A and 6B are schematic views each showing a positional relationship between an ejection face of the liquid ejection head and the recessed member in the printer in FIG. 1, wherein FIG. 6A is a view showing a situation in which the recessed member is located at a contact position, and FIG. 6B is a view showing a situation in which the recessed member is located at a distant position;

DETAILED DESCRIPTION OF THE EMBODIMENTS

Figure 1:
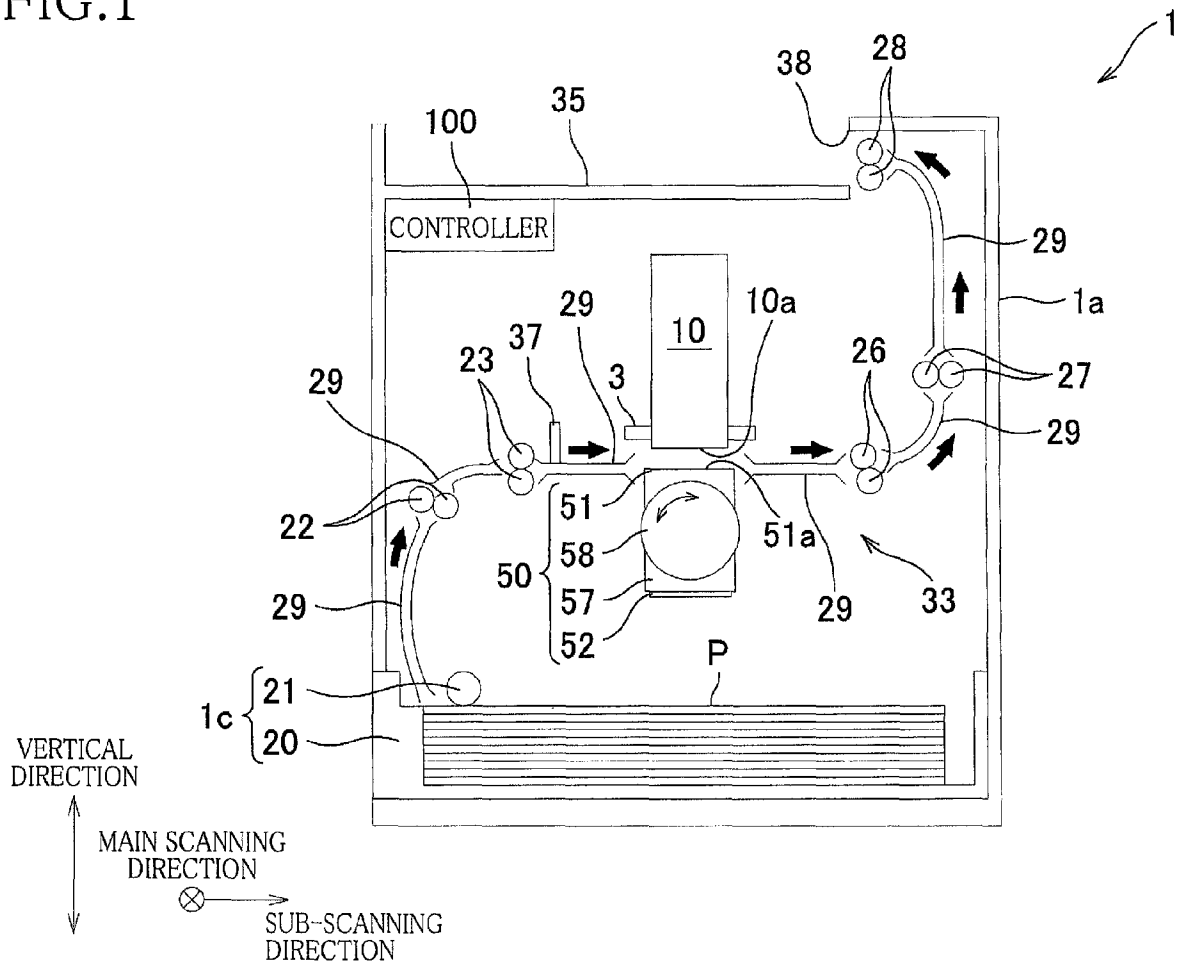
FIG. 1 is a side view generally showing an overall construction of an ink-jet printer as a first embodiment of the present invention.

Hereinafter, there will be described embodiments of the present invention with reference to the drawings by applying a liquid ejection apparatus to an ink-jet printer.

<First Embodiment>

First, there will be explained an overall construction of an ink-jet printer 1 as a first embodiment with reference to FIG. 1.

The printer 1 includes a housing 1*a* having a rectangular parallelepiped shape. A sheet-discharge portion 35 is provided on a top plate of the housing 1*a*. In a space defined by the housing 1*a*, there is formed a sheet conveyance path through which a sheet P (as one example of a recording medium) is conveyed from a sheet-supply unit 1*c* which will be described below toward the sheet-discharge portion 35 along bold arrows in FIG. 1.

The housing 1*a* accommodates (a) a liquid ejection head in the form of a head 10, (b) a conveyor mechanism 33 configured to convey the sheet P through a position facing or just under an ejection face 10*a* of the head 10, (c) a support-cap unit 50 corresponding to the head 10, (d) a humidification unit 60 (see FIG. 5) used for a humidifying maintenance, (e) a liquid suction unit 70 (see FIG. 5) used for a liquid removal maintenance, (f) a cartridge, not shown, storing black ink to be supplied to the head 10, (g) a touch panel 90 (see FIG. 7), and (i) a controller 100 for controlling operations of components of the printer 1, and so on.

The head 10 is a line head having a generally rectangular parallelepiped shape elongated in a main scanning direction. A lower face of the head 10 is the ejection face 10*a* having a multiplicity of ejection openings 14*a* (see FIGS. 3 and 4) opened therein. In image recording (image forming), the head 10 ejects the black ink from the ejection openings 14*a*. The head 10 is supported by the housing 1*a* via a head holder 3. The head holder 3 supports the head 10 such that a space appropriate for the image recording is formed between the ejection face 10*a* and a support face 51*a* which will be described below. A structure of the head 10 will be explained later in detail.

In a recording mode in which the ink is ejected from the ejection openings 14*a* onto the sheet P, the controller 100 controls a conveyance operation of the components of the printer 1 for conveying the sheet P and an ink ejecting operation synchronized with the conveyance operation of the sheet P on the basis of print data transmitted from an external device. Further, the controller 100 controls various maintenance operations.

The maintenance operations include flushing, purging, wiping, the humidifying maintenance, the liquid removal maintenance, and so on. The flushing is an operation for forcing the ink to be ejected from all the ejection openings 14*a* by driving ones or all of actuators of the head 10 on the basis of flushing data that is different from image data. The purging is an operation for forcing the ink to be ejected from all of the ejection openings 14*a* by applying a pressure to the ink in the head 10 by a purging mechanism 8 (see FIG. 7). The wiping is an operation for wiping foreign matters (e.g., the ink) on the ejection face 10*a* by a wiper 9 (see FIG. 7). The purging and the flushing (hereinafter collectively called a forced ejection maintenance) are performed when the ink is not ejected from the ejection openings 14*a* for a predetermined length of time (noted that this predetermined length of time may be set to be longer in the purging than in the flushing). In the purging and the flushing, the ink whose viscosity has increased in the ejection openings 14*a*, and air bubbles and dust particles in the ejection openings 14*a* are discharged with the ink from the ejection openings 14*a*. The humidifying maintenance and the liquid removal maintenance will be explained below in detail.

The conveyor mechanism 33 includes the sheet-supply unit 1*c*, a guide 29, conveyance-roller pairs 22, 26-28, and a register roller pair 23 and constitutes the sheet conveyance path extending from the sheet-supply unit 1*c* to the sheet-discharge portion 35. The sheet-supply unit 1*c*, the conveyance-roller pairs 22, 26-28, and the register roller pair 23 are controlled by the controller 100.

The sheet-supply unit 1*c* includes a sheet-supply tray 20 as an accommodating portion and a sheet-supply roller 21. The sheet-supply tray 20 can be mounted on and removed from the housing 1*a* in a sub-scanning direction. The sheet-supply tray 20 has a box-like shape opening upward and can accommodate sheets P. The sheet-supply roller 21 is rotated by control of the controller 100 to supply an uppermost one of the sheets P in the sheet-supply tray 20.

Here, the sub-scanning direction is a direction parallel to a conveying direction in which the sheet P is conveyed by the conveyor mechanism 33, and the main scanning direction is a direction parallel to a horizontal plane and perpendicular to the sub-scanning direction.

The sheet P supplied by the sheet-supply roller 21 is conveyed to the register roller pair 23 while being guided by the guide 29 and nipped by the conveyance roller pair 22. The register roller pair 23 nips a leading end of the sheet P conveyed by the conveyance roller pair 22 for a predetermined registering time in a state in which the register roller pair 23 is not rotated. As a result, an inclination (oblique conveyance) of the sheet P is corrected in the state in which the leading end of the sheet P is nipped by the register roller pair 23. After the registering time has passed, the register roller pair 23 is rotated to convey the sheet P whose inclination has been corrected, to the position between the head 10 and the support-cap unit 50.

When the sheet P has been conveyed to the position between the head 10 and the support-cap unit 50 by the register roller pair 23 and passes through the position just under the head 10 in the sub-scanning direction, the ink is ejected from the ejection openings 14*a*, whereby a monochrome image is formed on the sheet P. The ink ejecting operation from the ejection openings 14*a* is controlled by the controller 100 on the basis of a detection signal outputted from a sheet sensor 37. The sheet P is then conveyed upward by the conveyance-roller pairs 26-28 while being guided by the guide 29. The sheet P is finally discharged onto the sheet-discharge portion 35 through an opening 38 formed in an upper portion of the housing 1*a*.

Figure 2:
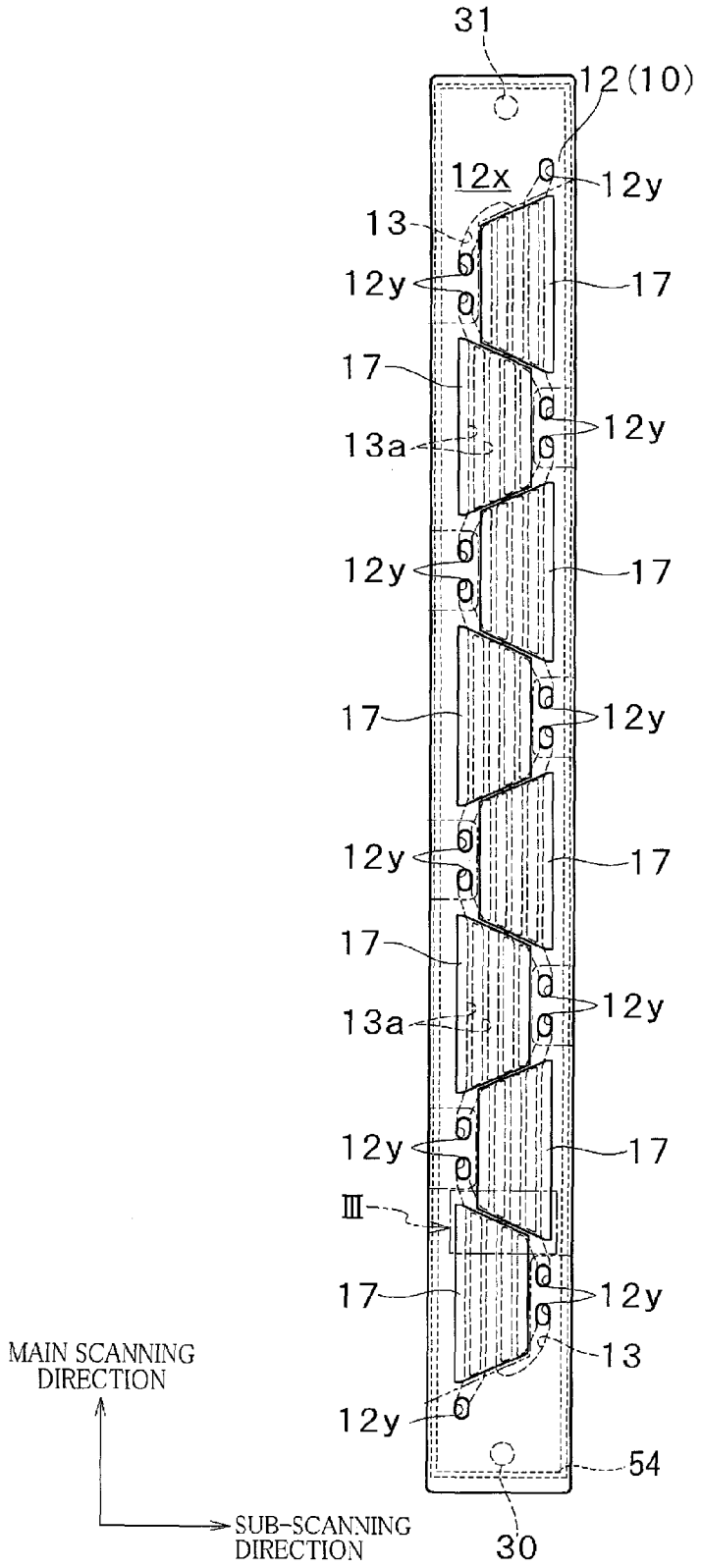
FIG. 2 is a plan view showing a channel unit and actuator units of a liquid ejection head of the printer in FIG. 1.
Figure 3:
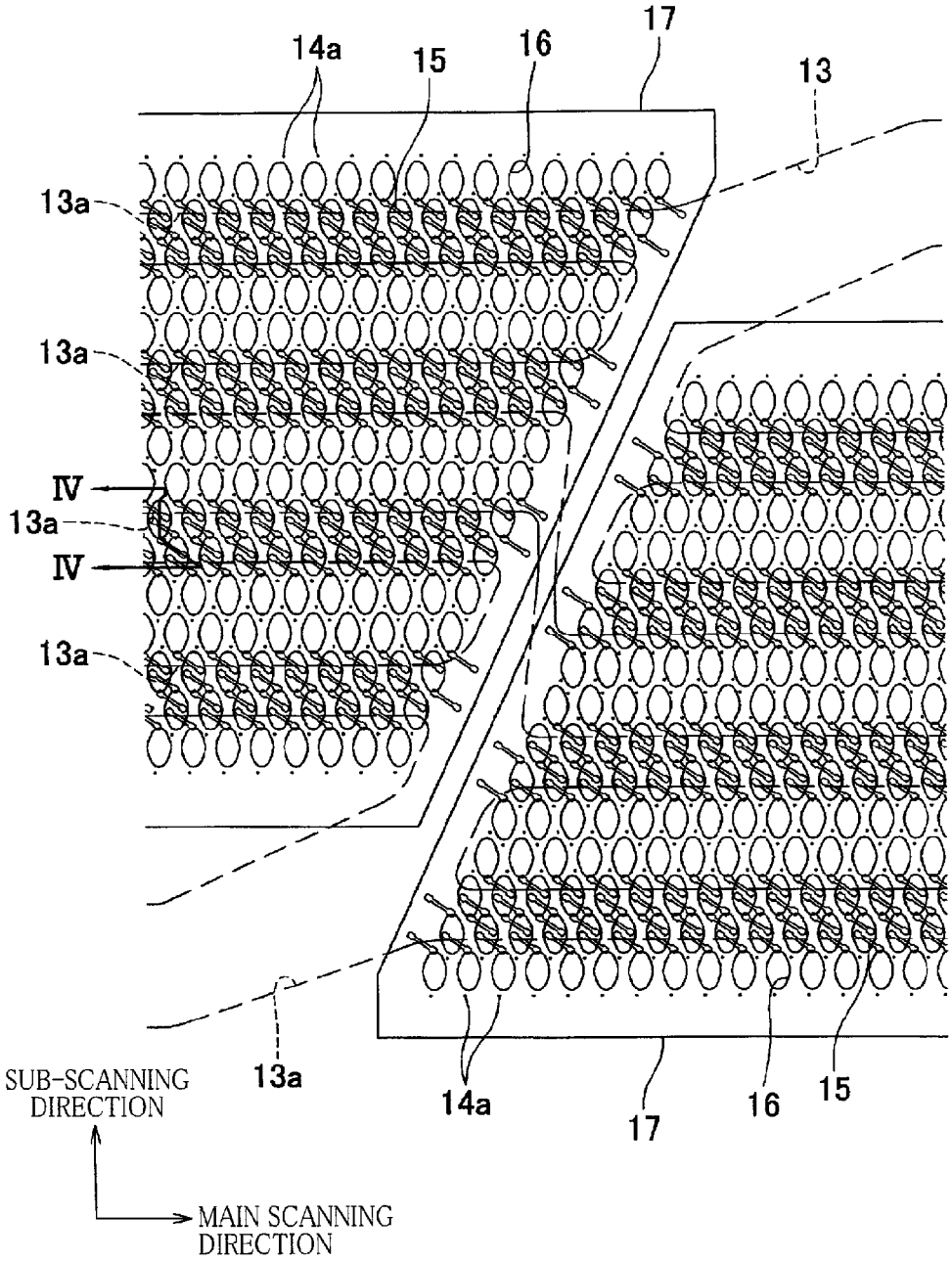
FIG. 3 is an enlarged view showing an area III enclosed by one-dot chain line in FIG. 2.
Figure 4:
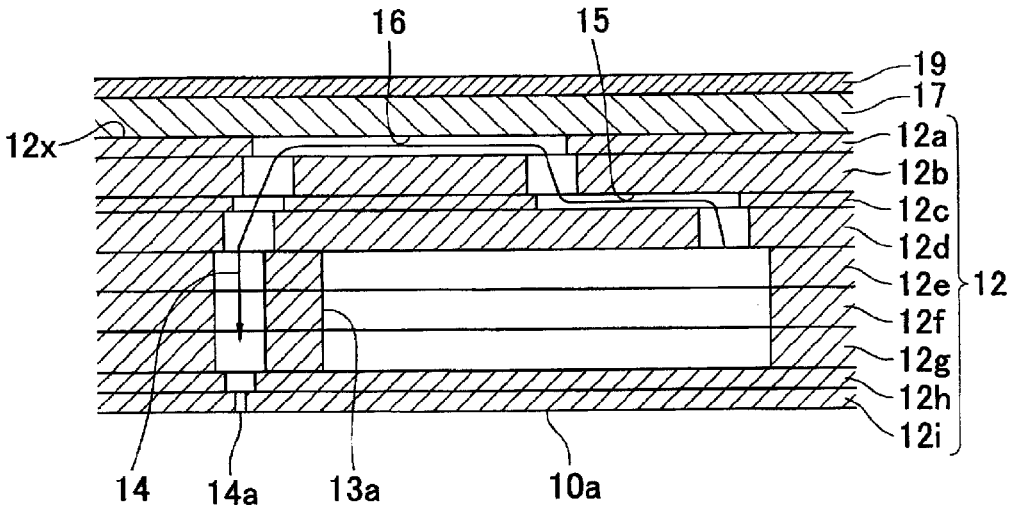
FIG. 4 is a partial cross-sectional view taken along line IV-IV in FIG. 3.

There will be next explained the structure of the head 10 with reference to FIGS. 2-4. It is noted that, in FIG. 3, pressure chambers 16 and apertures 15 are illustrated by solid lines for easier understanding purposes though these elements are located under actuator units 17 and thus should be illustrated by broken lines.

The head 10 includes a reservoir unit 11 (see FIG. 5), a channel unit 12 (see FIG. 4), the eight actuator units 17 (see FIG. 2) fixed to an upper face 12*x* of the channel unit 12, a Flexible Printed Circuit (FPC) 19 (see FIG. 4) bonded to each of the actuator units 17 and so on which are stacked on one another in a vertical direction. In the reservoir unit 11 are formed ink channels including a reservoir that temporarily stores the ink supplied from the cartridge. In the channel unit 12 are formed ink channels each extending from a corresponding one of openings 12*y* of the upper face 12*x* (see FIG. 2) to a corresponding one of the ejection openings 14*a* formed in a lower face of the channel unit 12 (i.e., the ejection face 10*a*). The actuator units 17 include piezoelectric actuators for the respective ejection openings 14*a*.

Protruding portions and recessed portions are formed on and in a lower face of the reservoir unit 11. The protruding portions are bonded to the upper face 12*x* of the channel unit 12 at areas on which no actuator units 17 are disposed (noted that the areas include the openings 12*y* and are enclosed with two-dot chain lines in FIG. 2). A distal end face of each of the protruding portions has an opening connected to the reservoir and facing a corresponding one of the openings 12*y* of the channel unit 12. As a result, the reservoir and individual ink channels 14 are communicated with each other via the above-described openings. The recessed portions face the upper face 12*x* of the channel unit 12, faces of the respective actuator units 17, and a face of the FPC 19 with slight spaces formed therebetween.

The channel unit 12 is a stacked body constituted by nine metal rectangular plates 12*a*-12*i* (see FIG. 4) having generally the same size and bonded to one another. As shown in FIGS. 2-4, the ink channels of the channel unit 12 include: manifold channels 13 each having a corresponding one of the openings 12*y* as one end; sub-manifold channels 13*a* each branched from a corresponding one of the manifold channels 13; and the individual ink channels 14 respectively extending from outlets of the sub-manifold channels 13*a* to the ejection openings 14*a* via the pressure chambers 16. As shown in FIG. 4, the individual ink channel 14 is formed for each ejection opening 14*a* so as to have the aperture 15 functioning as a restrictor for adjusting a channel resistance. Generally rhombic openings for respectively exposing the pressure chambers 16 are formed in matrix in areas on the upper face 12*x* to which the actuator units 17 are respectively bonded. The ejection openings 14*a* are formed in matrix in the same pattern as the pressure chambers 16, in the lower face (i.e., the ejection face 10*a*) at areas opposed to the areas on the upper face 12*x* to which the actuator units 17 are respectively bonded.

As shown in FIG. 2, the actuator units 17 each having a trapezoid shape are arranged on the upper face 12*x* in a staggered configuration in two rows. As shown in FIG. 3, each of the actuator units 17 covers the multiplicity of the pressure chambers 16 formed under the actuator unit 17. Though not shown, each of the actuator units 17 includes: a plurality of piezoelectric layers expanding over the multiplicity of the pressure chambers 16; and electrodes interposing the piezoelectric layers in a thickness direction of the actuator units 17. The electrodes include: a common electrode common for the pressure chambers 16 and individual electrodes provided for the respective pressure chambers 16. The individual electrodes are formed on a face of an uppermost one of the piezoelectric layers.

The FPC 19 has wirings corresponding to the respective electrodes of the actuator units 17, and a driver IC, not shown, is mounted on the wirings. The FPC 19 is fixed at one end thereof to the actuator units 17 and at the other end to a control board, not shown, of the head 10, which is disposed on an upper side of the reservoir unit 11. The FPC 19 is controlled by the controller 100 so as to send the driver IC various drive signals outputted from the control board and send the actuator units 17 signals produced by the driver IC.

There will be next explained the support-cap unit 50 with reference to FIGS. 1, 2, 5, and 6.

As shown in FIG. 1, the support-cap unit 50 is disposed so as to face the ejection face 10*a* of the head 10 in the vertical direction. The support-cap unit 50 includes: a rotor 58 having a shaft extending in the main scanning direction and rotatable about the shaft by the control of the controller 100; a platen 51 and a cap fixation member 57 fixed to an outer circumferential face of the rotor 58; a recessed member 52 fixed to the cap fixation member 57; and a rotor raising and lowering mechanism 56 (see FIG. 7) configured to move the rotor 58 upward or downward in the vertical direction.

The platen 51 is one size larger than the ejection face 10*a* in the main scanning direction and the sub-scanning direction and disposed so as to be opposed to the cap fixation member 57 in the vertical direction. A face of the platen 51 is the support face 51*a* for supporting the sheet P while facing the ejection face 10*a*. A material and a processing for the support face 51*a* are employed so as to reliably hold the sheet P. For example, a silicon layer having a low viscosity is formed on the support face 51*a*, and a multiplicity of ribs are formed on the support face 51*a* in the sub-scanning direction, preventing floating and the like of the sheet P placed on the support face 51*a*. The platen 51 is formed of a resin material.

The rotor 58 is controlled by the controller 100 to be rotated so as to selectively take or establish one of (i) a first rotation state (see FIG. 1) in which the support face 51*a* faces the ejection face 10*a* while a facing face 80 which will be described below does not face the ejection face 10*a* and (ii) a second rotation state (see FIG. 5) in which the support face 51*a* does not face the ejection face 10*a* while the facing face 80 faces the ejection face 10*a*. When the rotor 58 being in the first rotation state is rotated 180 degrees, the rotor 58 takes the second rotation state. In the present embodiment, the controller 100 controls the rotor 58 to take the first rotation state in the recording mode and in a recording waiting mode for waiting arrival of a print request and to take the second rotation state in a humidifying maintenance mode.

The rotor raising and lowering mechanism 56 supports the shaft of the rotor 58 and moves the rotor 58 upward or downward in the vertical direction by the control of the controller 100. This upward or downward movement of the rotor 58 moves the recessed member 52 fixed to the rotor 58 via the cap fixation member 57, thereby changing a vertical position of the recessed member 52 relative to the ejection face 10*a*. It is noted that a rack and a pinion, or a solenoid may be used as the rotor raising and lowering mechanism 56, for example.

Figure 5:
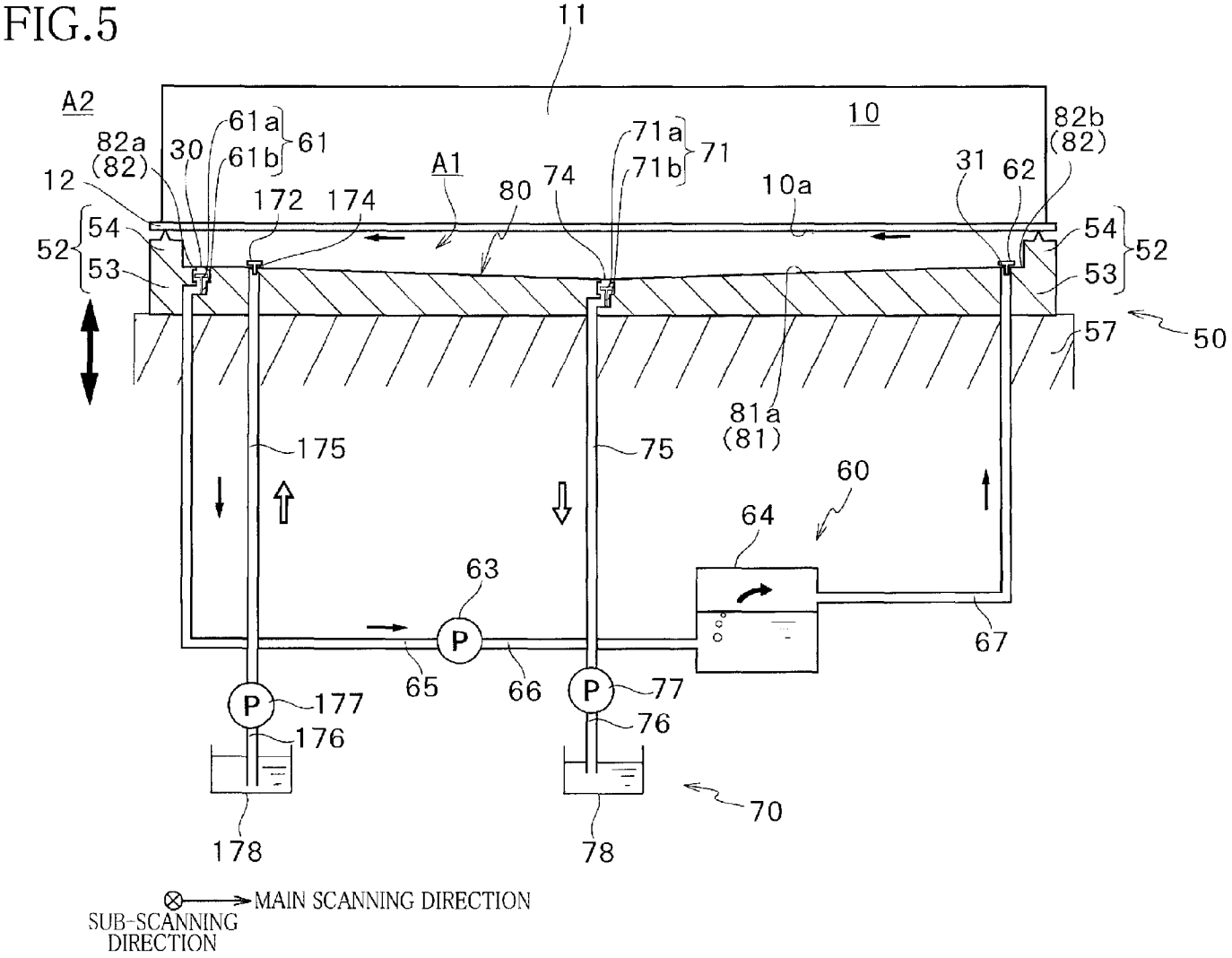
FIG. 5 is a schematic view showing the liquid ejection head, a recessed member, a humidification unit, and a liquid suction unit of the printer in FIG. 1.
Figure 6A:
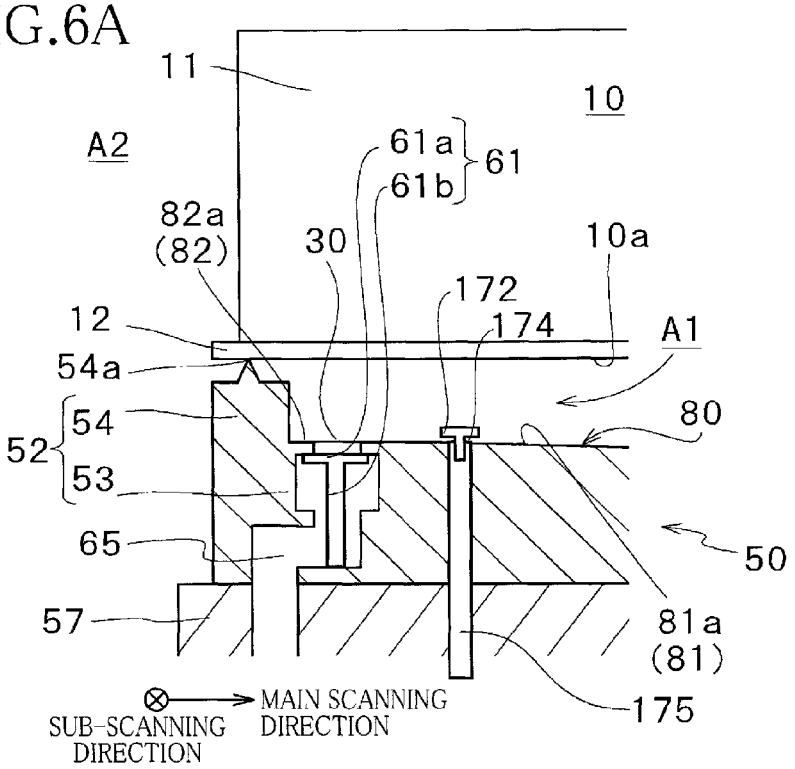
Figure 6B:
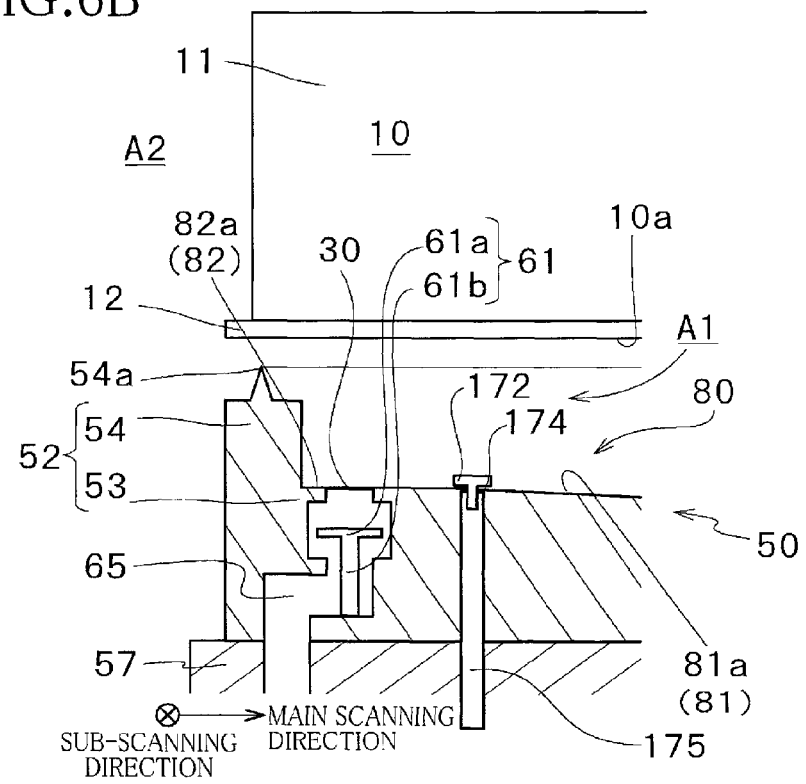

As shown in FIGS. 5, 6A, and 6B, the recessed member 52 is fixed to the cap fixation member 57 and constituted by (i) a facing member 53 that faces the ejection face 10*a* and (ii) an annular member 54 supported on an outer periphery of the facing member 53. The facing member 53 and the annular member 54 are formed integrally with each other. The annular member 54 is formed of an elastic material such as rubber, and as shown in FIG. 2 has an annular shape such that all the actuator units 17, i.e., all the ejection openings 14*a*, of the ejection face 10*a* are surrounded by the annular member 54 in plan view.

In the state in which the facing face 80 faces the ejection face 10*a*, the upward or downward movement of the rotor 58 by the rotor raising and lowering mechanism 56 moves the recessed member 52 selectively to one of (i) a contact position (see FIG. 6A) at which a distal end 54*a* of the annular member 54 contacts with the ejection face 10*a* of the head 10 and (ii) a distant position (see FIG. 6B) at which the distal end 54*a* of the annular member 54 is distant from the ejection face 10*a* of the head 10. As shown in FIG. 6A, when the recessed member 52 is located at the contact position, an ejection space A1 under (facing) the ejection face 10*a* is sealed by the recessed member 52 and the ejection face 10*a* so as to be isolated from an outside space A2. It is noted that, when the recessed member 52 is located at the distant position, the ejection space A1 under the ejection face 10*a* is not sealed or isolated from the outside space A2. In the present embodiment, the recessed member 52 is one example of a sealing mechanism that is moved to selectively take one of (i) a sealing state for sealing or isolating the ejection space A1 from the outside space A2 (i.e., the state in which the recessed member 52 is located at the contact position) and (ii) an unsealing (open) state in which the ejection space A1 is not sealed or isolated from the outside space A2 (i.e., the state in which the recessed member 52 is located at the distant position).

The facing member 53 is formed of a material such as a glass or a metal (e.g., SUS) having a property of not or hardly absorbing water. The facing face 80 has or is divided into an ejection area 81 and an outer peripheral area 82 surrounding this ejection area 81. The ink discharged from the ejection openings 14*a* (e.g., by the forced ejection) contacts or is landed on the ejection area 81 in the state in which the facing face 80 faces the ejection face 10*a*. The ink discharged from the ejection openings 14*a* does not contact or is not landed on the outer peripheral area 82. This outer peripheral area 82 is mainly constituted by: a pair of outer peripheral areas 82*a*, 82*b* between which the ejection area 81 is interposed in the main scanning direction; and a pair of outer peripheral areas, not shown, between which the ejection area 81 is interposed in the sub-scanning direction. It is noted that the words "the ink contacts the ejection area 81" mean various types of contacts including adhesion of the ink as long as the ink is present on the ejection area 81.

An air outlet opening 30 is open in the outer peripheral area 82*a* of the facing face 80, and an air introduction opening 31 is open in the outer peripheral area 82*b* of the facing face 80. In the humidifying maintenance, air humidified in a tank 64 which will be described below is supplied through the air introduction opening 31 into the ejection space A1, and an air in the ejection space A1 is discharged through the air outlet opening 30. That is, the air outlet opening 30 and the air introduction opening 31 are formed in an area that faces the ejection space A1 when the recessed member 52 is in the sealing state.

As described above, the air outlet opening 30 is open in the outer peripheral area 82*a*, and the air introduction opening 31 is open in the outer peripheral area 82*b*. Thus, when the recessed member 52 is located at the contact position (the sealing state), all the ejection openings 14*a* are interposed between the air introduction opening 31 and the air outlet opening 30 in the main scanning direction when seen in a direction facing the ejection openings 14*a* (i.e., a direction perpendicular to the ejection face 10*a*). As a result, in the humidifying maintenance, the air in the ejection space A1 flows from one end portion of the ejection face 10*a* toward the other end portion thereof in the main scanning direction, making it possible to efficiently humidify the ejection space. This suppresses vaporization of the ink near the ejection openings 14*a* and thereby suppresses an occurrence of clogging of the ejection openings 14*a*.

As shown in FIG. 5, the facing face 80 has a recessed portion 81*a* inclined downward from an outer edge of the ejection area 81 toward a central portion of the facing face 80. It is noted that the outer peripheral area 82 is formed at a height position equal to or greater than that of the outer edge of the ejection area 81 in the vertical direction. A liquid suction opening 74 is formed in this central portion of the recessed portion 81*a* in the main scanning direction. In the liquid removal maintenance, the ink adhering to the ejection area 81 and cleaning liquid supplied into the ejection space A1 by a supply pump 177 which will be described below are sucked by the liquid suction unit 70 into an outside of the ejection space A1 via the liquid suction opening 74. It is noted that the liquid sucked from the liquid suction opening 74 includes ink peeled or separated from the ejection area 81 by the cleaning liquid supplied into the ejection space A1.

Since the liquid suction opening 74 is formed in the central portion of the recessed portion 81*a*, the opening 74 is located below the air outlet opening 30 and the air introduction opening 31 in a gravity direction, i.e., the vertical direction. Thus, the ink adhering to the ejection area 81 and the cleaning liquid can be guided to the liquid suction opening 74 in the liquid removal maintenance, making it possible for the liquid suction unit 70 to efficiently suck the ink and the cleaning liquid.

A cleaning-liquid supply opening 174 is formed in the facing face 80. The supply pump 177 supplies the cleaning liquid from this cleaning-liquid supply opening 174 into the ejection space A1. It is noted that the cleaning-liquid supply opening 174 is formed in the facing face 80 in the present embodiment but may be formed in the annular member 54 at its area facing or contacting the ejection space A1 or in the head 10 at its area facing or contacting the ejection space A1.

There will be next explained a structure of the humidification unit 60 with reference to FIG. 5.

As shown in FIG. 5, the humidification unit 60 includes: tubes 65-67 as one example of a circulation channel; an air supply pump 63; and the tank 64. One end of the tube 65 is communicated with the air outlet opening 30 formed in the outer peripheral area 82*a* of the facing face 80, and the other end thereof is communicated with the air supply pump 63. An open/close valve mechanism 61 for opening/closing the air outlet opening 30 is provided on the one end of the tube 65. This open/close valve mechanism 61 is mainly constituted by a valve member 61*a* and an actuator 61*b*. The actuator 61*b* is driven by the controller 100, whereby the valve member 61*a* is selectively positioned at one of: an upper position (see FIG. 6A) for closing the air outlet opening 30; and a lower position (see FIG. 6B) for opening the air outlet opening 30. It is noted that the actuator 61*b* may be a spring member for merely urging the valve member 61*a* toward the outer peripheral area 82*a* of the facing face 80 (i.e., toward an upper side in FIG. 6). In this configuration, the actuator 61*b* is not driven by the controller 100, but the valve member 61*a* is positioned at the lower position for opening the air outlet opening 30 by an increase in a pressure in the ejection space A1 due to the supply of the air humidified in the tank 64 which will be described below into the ejection space A1.

One end of the tube 66 is communicated with the air supply pump 63, and the other end thereof is communicated with the tank 64. One end of the tube 67 is communicated with the air introduction opening 31 formed in the outer peripheral area 82*b* of the facing face 80, and the other end thereof is communicated with the tank 64. A one-way valve 62 is provided in the one end of the tube 67 for inhibiting the ink and the cleaning liquid in the ejection space A1 from flowing into the tube 67.

The tank 64 stores water in its lower space and stores in its upper space the humid air humidified by the water in the lower space. The tube 66 is connected to the tank 64 below a water surface so as to be communicated with the lower space of the tank 64. The tube 67 is connected to the tank 64 above the water surface so as to be communicated with the upper space of the tank 64. The air supply pump 63 is controlled by the controller 100 to generate an air circulation between the ejection space A1 and the tank 64. As a result, the air in the ejection space A1 which is collected from the air outlet opening 30 via the tubes 65, 66 is humidified in the tank 64, and this humidified air is supplied from the air introduction opening 31 into the ejection space A1 via the tube 67. It is noted that a check valve, not shown, is attached in the tube 66 for inhibiting the water in the tank 64 from flowing into the air supply pump 63, so that the air flows only in a direction indicated by black arrows in FIG. 5. In the present embodiment, the tubes 65-67, the air supply pump 63, and the tank 64 are one example of a humid air supplier.

There will be next explained a structure of the liquid suction unit 70 with reference to FIG. 5. In the present embodiment, this liquid suction unit 70 is one example of the cleaner.

As shown in FIG. 5, the liquid suction unit 70 includes suction tubes 75, 76, a suction pump 77, a waste-ink tank 78, and cleaning-liquid tubes 175, 176, the supply pump 177, and a cleaning-liquid tank 178 for storing the cleaning liquid therein. One end of the suction tube 75 is communicated with the liquid suction opening 74 formed in the central portion of the ejection area 81 of the facing face 80, and the other end thereof is communicated with the suction pump 77. It is noted that an open/close valve mechanism 71 for opening/closing the liquid suction opening 74 is provided in the one end of the suction tube 75. This open/close valve mechanism 71 is mainly constituted by a valve member 71*a* and an actuator 71*b*. The actuator 71*b* is driven by the controller 100, whereby the valve member 71*a* is positioned at one of an upper position for closing the liquid suction opening 74; and a lower position for opening the liquid suction opening 74. One end of the suction tube 76 is communicated with the suction pump 77, and the other end thereof is communicated with the waste-ink tank 78.

One end of the cleaning-liquid tube 175 is communicated with the cleaning-liquid supply opening 174, and the other end thereof is communicated with the supply pump 177. A one-way valve 172 is provided in the one end of the cleaning-liquid tube 175 for inhibiting the cleaning liquid from flowing backward from the ejection space A1. One end of a cleaning-liquid tube 176 is communicated with the supply pump 177, and the other end thereof is communicated with the cleaning-liquid tank 178.

Under the control of the controller 100, the supply pump 177 sucks the cleaning liquid stored in the cleaning-liquid tank 178 to supply the cleaning liquid into the ejection space A1 via the cleaning-liquid supply opening 174. Further, under the control of the controller 100, the suction pump 77 sucks the ink adhering to the ejection area 81 and the cleaning liquid to discharge them to the waste-ink tank 78. In the present embodiment, the cleaning-liquid tubes 175, 176, the supply pump 177, and the cleaning-liquid tank 178 are one example of a cleaning liquid supplier. It is noted that the suction pump 77, when sucking the ink adhering to the ejection area 81 and the cleaning liquid, sucks them with such a power that a meniscus of the ink formed in each ejection opening 14*a* of the head 10 is not broken.

Figure 7:
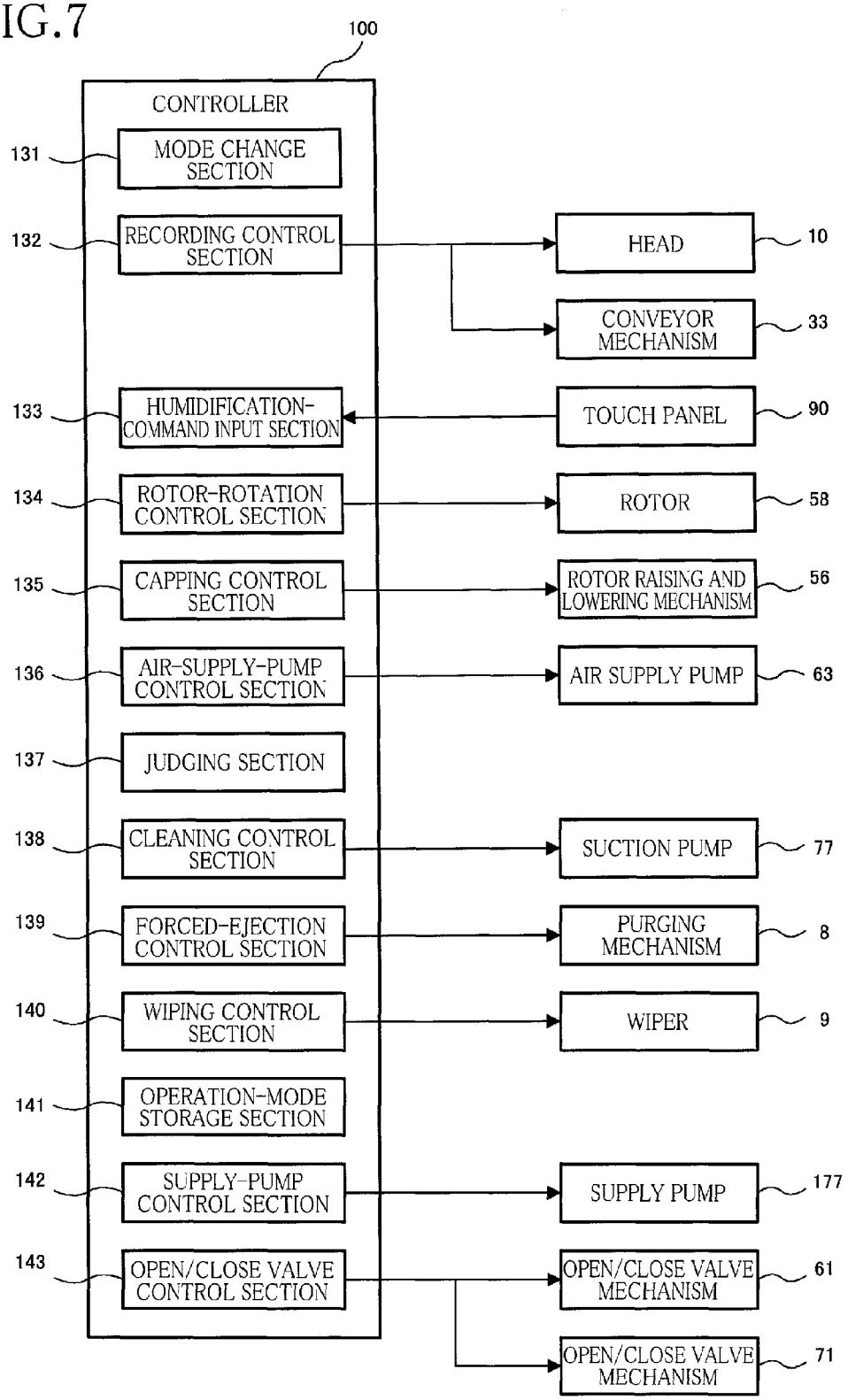
FIG. 7 is a block diagram showing an electric configuration of the printer in FIG. 1.

There will be next explained the controller 100 in detail with reference to FIG. 7. The controller 100 includes a central processing unit (CPU), a read only memory (ROM) rewritably storing therein programs to be executed by the CPU and data used for these programs; a random access memory (RAM) temporarily storing data therein upon the execution of the program. Control programs are stored in the ROM. When the control programs are executed by the CPU, various functional sections of the controller 100 shown in FIG. 7 are operated. The controller 100 transmits and receives data to and from the external device such as a personal computer (PC) via an I/F.

As shown in FIG. 7, the controller 100 is for controlling overall components and operations of the printer 1 and includes a mode change section 131, a recording control section 132, a humidification-command input section 133, a rotor-rotation control section 134, a capping control section 135, an air-supply-pump control section 136, a judging section 137, a cleaning control section 138, a forced-ejection control section 139, a wiping control section 140, an operation-mode storage section 141 storing an operation mode of the printer 1, a supply-pump control section 142, and an open/close valve control section 143.

The mode change section 131 changes the operation mode stored in the operation-mode storage section 141. Specifically, when the print request transmitted from the external device is received, the mode change section 131 changes the operation mode of the printer 1 to the recording mode. Further, when the image recording based on the print request is finished, the mode change section 131 changes the operation mode to the recording waiting mode. Further, when the humidifying command transmitted from the humidification-command input section 133 is received, the mode change section 131 changes the operation mode to the humidifying maintenance mode.

When the operation mode stored in the operation-mode storage section 141 is the recording mode, the recording control section 132 controls the head 10 and the conveyor mechanism 33 to eject the ink onto the sheet P on the basis of print data associated with the print request transmitted from the external device (i.e., data based on which the head 10 ejects the ink).

The humidification-command input section 133 is configured to input or transmit a humidifying command to the mode change section 131 when a user inputs a forcible humidification command using the touch panel 90 or when the print request is not received until a predetermined length of time passes after the image recording based on the print request is finished.

The rotor-rotation control section 134 is configured to change the rotor 58 from the first rotation state to the second rotation state when the mode change section 131 changes the operation mode stored in the operation-mode storage section 141 from the recording waiting mode to the humidifying maintenance mode. Further, the rotor-rotation control section 134 is configured to change the rotor 58 from the second rotation state to the first rotation state when the mode change section 131 changes the operation mode stored in the operation-mode storage section 141 from the humidifying maintenance mode to the recording mode.

The capping control section 135 is configured to control the rotor raising and lowering mechanism 56 to move the rotor 58 upward and downward. Specifically, when the mode change section 131 changes the operation mode stored in the operation-mode storage section 141 from the recording waiting mode to the humidifying maintenance mode, the capping control section 135 moves the rotor 58 upward to move the recessed member 52 upward from the distant position (see FIG. 6B) to the contact position (see FIG. 6A). On the other hand, when the mode change section 131 changes the operation mode stored in the operation-mode storage section 141 from the humidifying maintenance mode to the recording mode, the capping control section 135 moves the rotor 58 downward to move the recessed member 52 downward from the contact position to the distant position.

The air-supply-pump control section 136 is configured, when the operation mode stored in the operation-mode storage section 141 is the humidifying maintenance mode, to control the air supply pump 63 to perform the humidifying maintenance such that the humid air is supplied into the ejection space A1.

The judging section 137 is configured, when the mode change section 131 changes the operation mode stored in the operation-mode storage section 141 from the recording waiting mode to the humidifying maintenance mode, to judge whether the cleaning control section 138 is to perform the liquid removal maintenance before the humidifying maintenance controlled by the air-supply-pump control section 136. Specifically, the judging section 137 judges that the liquid removal maintenance is to be performed, when a length of time elapsed from the previous liquid removal maintenance is equal to or greater than a predetermined length of time. In the present embodiment, the predetermined length of time is a length of time required for an amount of water content contained in the ink contacting the area facing the ejection space A1, to become equal to or less than a predetermined amount due to drying. It is noted that the predetermined length of time is a predetermined period and may be a fixed period in the ink-jet printer 1 and may be a period which varies according to an environment in the ink-jet printer 1 such as a temperature and humidity.

The cleaning control section 138 is configured, when the judging section 137 judges that the liquid removal maintenance is to be performed, to drive the suction pump 77 to perform the liquid removal maintenance before the humidifying maintenance is performed, such that the ink contacting, e.g., the facing face 80 of the recessed member 52 and/or the ejection face 10*a* of the head 10 at the area facing the ejection space A1 is sucked to the outside of the ejection space A1.

The forced-ejection control section 139 is configured to control the purging mechanism 8 to perform the forced ejection maintenance such that the ink is purged or forcefully ejected from the head 10 toward the ejection area 81 of the facing face 80, when the mode change section 131 changes the operation mode stored in the operation-mode storage section 141 from the humidifying maintenance mode to the recording mode, for example.

The wiping control section 140 is configured, when the forced ejection maintenance controlled by the forced-ejection control section 139 is finished, to control the wiper 9 to wipe or remove foreign matters such as the ink from the ejection face 10*a*. It is noted that the wiper 9 is a plate-like member formed of an elastic material such as rubber and extending in the sub-scanning direction. The wiping control section 140 controls the wiper 9 to move in the main scanning direction while contacting the ejection face 10*a*, thereby removing the foreign matters on the ejection face 10*a*.

The operation-mode storage section 141 stores therein one of the recording mode, the recording waiting mode, and the humidifying maintenance mode.

The supply-pump control section 142 is configured, when the liquid removal maintenance is performed, to control the supply pump 177 to supply the cleaning liquid into the ejection space A1.

The open/close valve control section 143 is configured, when the cleaning liquid is supplied into the ejection space A1 by the supply pump 177, to control the open/close valve mechanism 61 and the open/close valve mechanism 71 to close the air outlet opening 30 and the liquid suction opening 74. In the present embodiment, the mode change section 131, the capping control section 135, the air-supply-pump control section 136, the cleaning control section 138, the supply-pump control section 142, and the open/close valve control section 143 are one example of a controller.

Figure 8:
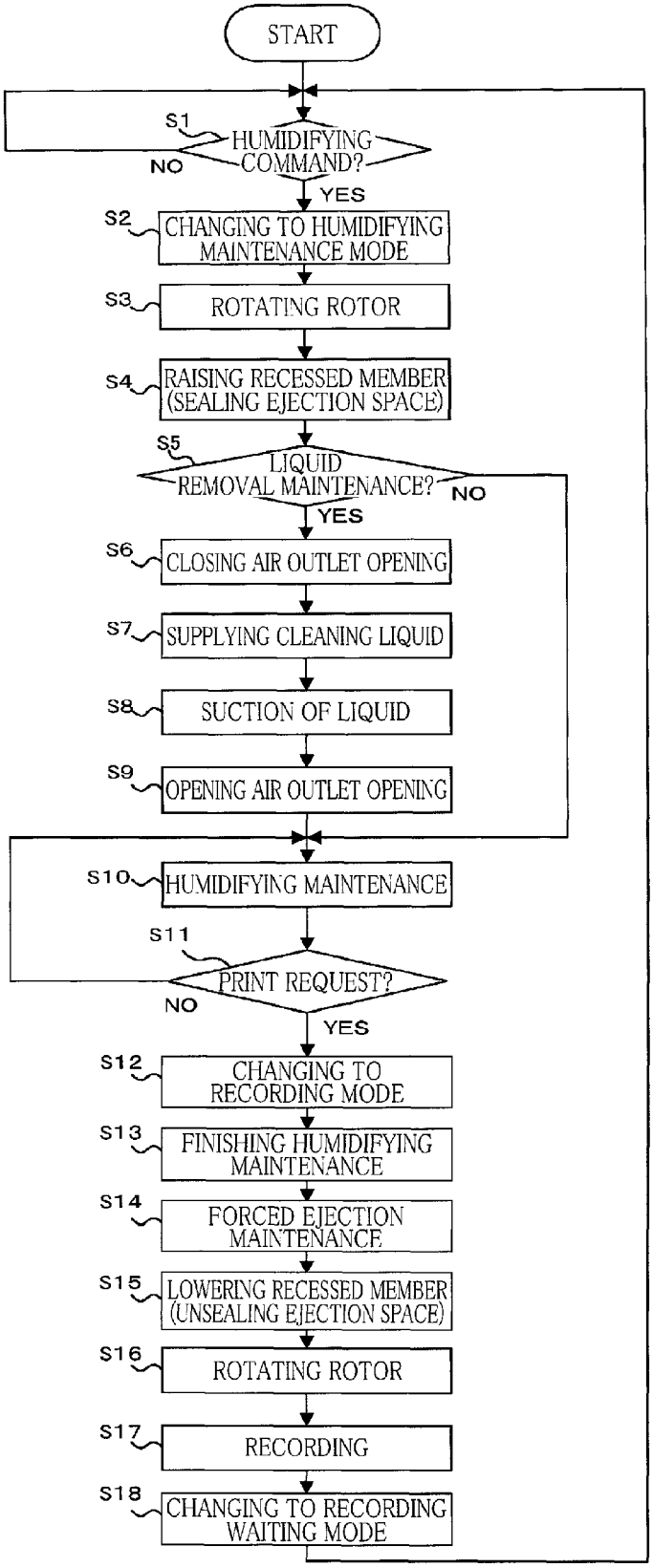
FIG. 8 is a flow-chart showing a series of operations including a humidifying maintenance and a liquid removal maintenance controlled by a controller of the printer in FIG. 1.

There will be next explained a flow of a series of operations including the humidifying maintenance and the liquid removal maintenance in the printer 1 with reference to FIG. 8. It is noted that the operation mode stored in the operation-mode storage section 141 at a start of this operation flow in FIG. 8 is the recording waiting mode.

Initially in S1, the mode change section 131 judges whether the humidifying command has been received from the humidification-command input section 133. When the mode change section 131 judges that the humidifying command has not been received (S1: NO), the processing in S1 is repeated.

On the other hand, when the mode change section 131 judges that the humidifying command has been received (S1: YES), the mode change section 131 in S2 changes the operation mode stored in the operation-mode storage section 141 to the humidifying maintenance mode. Then in S3, the rotor-rotation control section 134 rotates the rotor 58 so as to change the rotor 58 from the first rotation state to the second rotation state. As a result, the facing face 80 of the facing member 53 faces the ejection face 10*a*.

Then in S4, the capping control section 135 controls the rotor raising and lowering mechanism 56 to move the rotor 58 upward such that the recessed member 52 is moved upward from the distant position to the contact position. As a result, the distal end 54*a* of the annular member 54 of the recessed member 52 is brought into contact with the ejection face 10*a*, so that the ejection space A1 facing the ejection face 10*a* is sealed so as to be isolated from the outside space A2.

Then in S5, the judging section 137 judges whether the liquid removal maintenance is to be performed before the humidifying maintenance is performed. Specifically, the judging section 137 judges whether the length of time elapsed from the previous liquid removal maintenance is equal to or greater than the predetermined length of time. When the judging section 137 judges that the liquid removal maintenance is not to be performed (S5: NO), that is, when the judging section 137 judges that the length of time elapsed from the previous liquid removal maintenance is less than the predetermined length of time, the flow goes to S10. On the other hand, when the judging section 137 judges that the liquid removal maintenance is to be performed (S5: YES), that is, when the judging section 137 judges that the length of time elapsed from the previous liquid removal maintenance is equal to or greater than the predetermined length of time, the flow goes to S6.

In S6, the open/close valve control section 143 drives the actuator 61*b* of the open/close valve mechanism 61 to move the valve member 61*a* upward from the lower position to the upper position (see FIG. 6A) to close the air outlet opening 30. Further, the open/close valve control section 143 drives the actuator 71*b* of the open/close valve mechanism 71 to move the valve member 71*a* upward from the lower position to the upper position to close the liquid suction opening 74.

Then in S7, the supply-pump control section 142 drives the supply pump 177 to supply the cleaning liquid into the sealed ejection space A1. As a result, the ink adhering to the head 10 and the recessed member 52 at the areas facing the ejection space A1 (e.g., the ejection face 10*a* and the facing face 80) can be washed away with the cleaning liquid. It is noted that, since the air outlet opening 30 is closed by the valve member 61*a*, and the one-way valve 62 is provided in the air introduction opening 31 as described above, the cleaning liquid supplied into the ejection space A1 never flows into the air supply pump 63 and the tank 64.

Then in S8, the open/close valve control section 143 drives the actuator 71*b* of the open/close valve mechanism 71 to move the valve member 71*a* downward from the upper position to the lower position to open the liquid suction opening 74, and then the cleaning control section 138 drives the suction pump 77 to discharge the ink washed away with the cleaning liquid, to the waste-ink tank 78 located outside the ejection space A1. As a result, an amount of the ink in the ejection space A1 can be reduced, making it possible to speedily humidify the ejection space A1 in the humidifying maintenance to be performed later. Further, it is possible to prevent the ink from flowing into the air outlet opening 30 and the air introduction opening 31 in the air circulation in the humidifying maintenance, thereby suppressing clogging of the air outlet opening 30, the air introduction opening 31, and the circulation channel (the tubes 65-67).

Then in S9, the open/close valve control section 143 drives the actuator 61*b* of the open/close valve mechanism 61 to move the valve member 61*a* downward from the upper position to the lower position to open the air outlet opening 30. When the processing in S9 is finished, the flow goes to S10.

In S10, the humidifying maintenance is performed in which the air-supply-pump control section 136 drives the air supply pump 63 to generate the air circulation between the ejection space A1 and the tank 64. Specifically, the air supply pump 63 is driven, and thereby the air in the ejection space A1 is collected from the air outlet opening 30. The air collected from the air outlet opening 30 flows to the air supply pump 63 through the tube 65 and then to the tank 64 through the tube 66. The air is supplied into the lower space of the tank 64 below the water surface. The air humidified by the water in the tank 64 is discharged from the upper space of the tank 64, then flows through the tube 67, and then is supplied into the ejection space A1 from the air introduction opening 31. Since the humid air is supplied into the ejection space A1 as thus described, the vaporization of the ink near the ejection openings 14*a* can be suppressed, thereby preventing the clogging of the ejection openings 14*a*. Further, even if a viscosity of the ink near the ejection openings 14*a* has been increased, the water content in the humid air is supplied to the ink, thereby eliminating or resolving the thickening of the ink.

Then in S11, the mode change section 131 judges whether the print request has been received from the external device. When the mode change section 131 judges that the print request has not been received (S11: NO), the flow returns to S10. On the other hand, when the mode change section 131 judges that the print request has been received (S11: YES), the mode change section 131 in S12 changes the operation mode stored in the operation-mode storage section 141 to the recording mode, and then the air-supply-pump control section 136 in S13 stops the air supply pump 63 to finish the humidifying maintenance.

Then in S14, the forced-ejection control section 139 controls the purging mechanism 8 to perform the forced ejection maintenance in which the ink is purged from the head 10 toward the ejection area 81 of the facing face 80. As a result, the ink contacts the ejection area 81. It is noted that the forced-ejection control section 139 may control the head 10 to perform the flushing in S13 instead of performing the purging.

Then in S15, the capping control section 135 controls the rotor raising and lowering mechanism 56 to move the rotor 58 downward such that the recessed member 52 is moved downward from the contact position to the distant position. As a result, the distal end 54*a* of the annular member 54 of the recessed member 52 comes off the ejection face 10*a*, so that the ejection space A1 facing the ejection face 10*a* is not sealed or isolated from the outside space A2.

Then in S16, the rotor-rotation control section 134 rotates the rotor 58 so as to change the rotor 58 from the second rotation state to the first rotation state. As a result, the support face 51*a* of the platen 51 faces the ejection face 10*a*.

Then in S17, the recording control section 132 controls the head 10 and the conveyor mechanism 33 based on the print data associated with the print request to record the image on the sheet P. Then in S18, the mode change section 131 changes the operation mode stored in the operation-mode storage section 141 to the recording waiting mode upon completion of the image recording based on the print request, and the flow returns to S1.

As described above, in the present embodiment, when the length of time elapsed from the previous liquid removal maintenance is equal to or greater than the predetermined length of time, the liquid suction unit 70 sucks the liquid before the humidifying maintenance is performed (i.e., before the air in the ejection space A1 is discharged and before the humid air is supplied into the ejection space A1), thereby reducing the amount of the ink whose water content has been reduced and which is present on the recessed member 52 at its area facing the ejection space A1 (e.g., the facing face 80 and an inside face of the annular member 54). As a result, the ejection space A1 can be humidified speedily in the humidifying maintenance. Further, it is possible to suppress the flowing of the liquid into the air outlet opening 30 when the air in the ejection space A1 is discharged in the humidifying maintenance. This makes it possible to suppress that the air outlet opening 30, the air introduction opening 31, and the circulation channel (the tubes 65-67) are clogged by the ink and to suppress that the ink flows into the air supply pump 63 and the tank 64 (the humid air supplier), leading to lower functionality of the air supply pump 63 and the tank 64. Thus, it is possible to suppress a lowering of a functionality of the humidification in the printer 1.

Further, the cleaning liquid is supplied into the ejection space A1 to wash away the ink being present on the head 10 and the recessed member 52 at the areas facing the ejection space A1, with the cleaning liquid, and then the liquid is sucked by the liquid suction unit 70. Thus, it is possible, before the humidifying maintenance, to further reduce the amount of the ink whose water content has been reduced and which is present on the head 10 and the recessed member 52 at the areas facing the ejection space A1.

Further, since the recessed member 52 partly constitutes a sealing mechanism, the sealing mechanism has a simple structure, making it easy to perform the removal and cleaning of the liquid suction unit 70.

<Second Embodiment>

Figure 9:
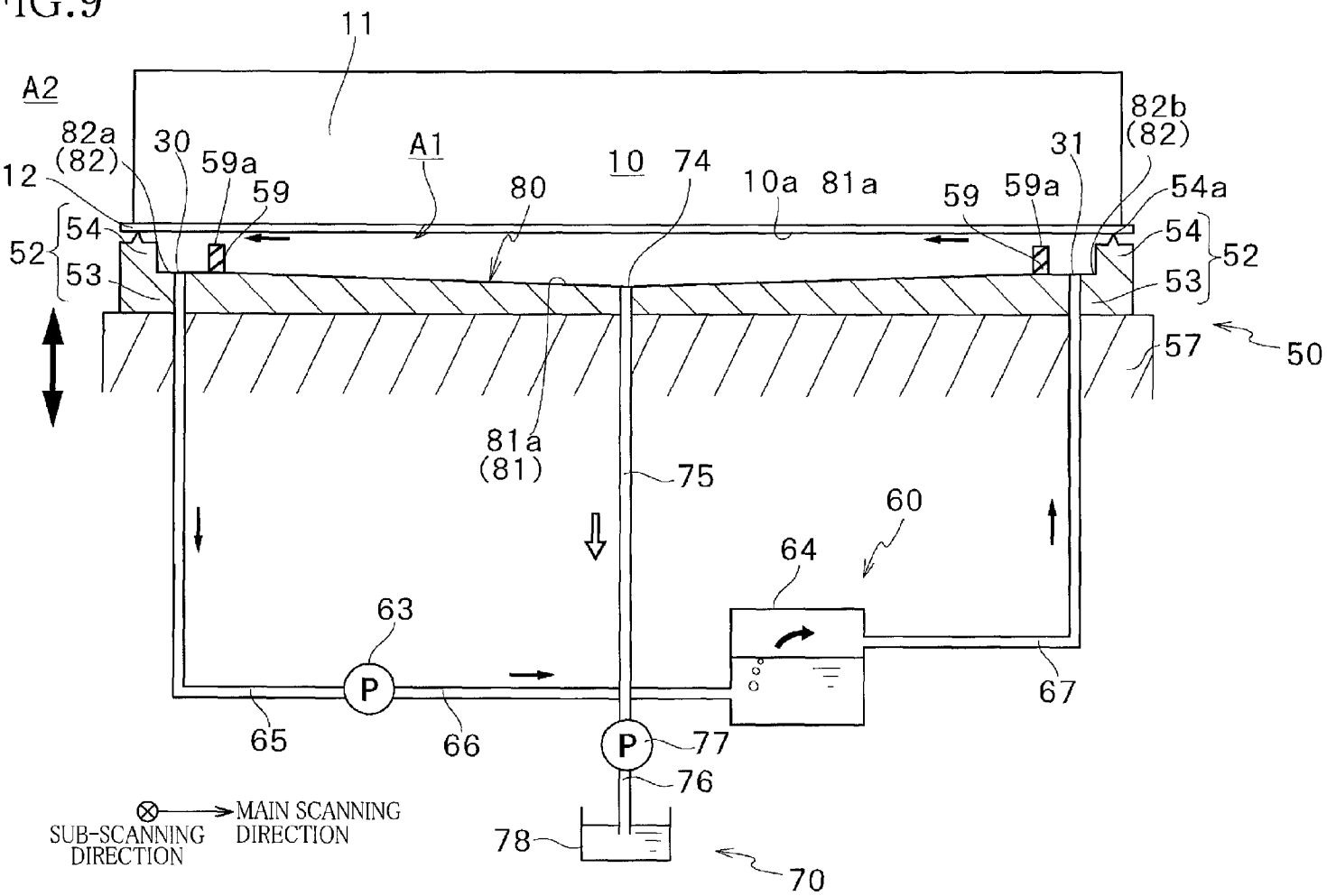
FIG. 9 is a schematic view, corresponding to FIG. 5, showing an ink-jet printer as a second embodiment of the present invention.

There will be next explained a printer as a second embodiment of the present invention with reference to FIG. 9. This second embodiment is different from the first embodiment in that preventive plates 59 are provided on the facing member 53 such that the ejection area 81 is interposed therebetween in the main scanning direction. In this second embodiment, the liquid suction unit 70 does not include the cleaning liquid supplier (the cleaning-liquid tubes 175, 176, the supply pump 177, and the cleaning-liquid tank 178). Further, in this second embodiment, the wiper 9 wipes the head 10 in the liquid removal maintenance so as to remove the ink contacting the head 10 at the area facing or contacting the ejection space A1. That is, in this second embodiment, the wiper 9 and the liquid suction unit 70 are one example of the cleaner, and the mode change section 131, the capping control section 135, the air-supply-pump control section 136, the cleaning control section 138, and the wiping control section 140 are one example of the controller. It is noted that the same reference numerals as used in the first embodiment are used to designate the corresponding elements of the second embodiment, and an explanation of which is dispensed with.

In the present embodiment, the liquid suction unit 70 mainly sucks the ink adhering to the ejection area 81. As shown in FIG. 9, the preventive plates 59 each one example of a preventive member are respectively provided at a boundary between the ejection area 81 and the outer peripheral area 82*a* and at a boundary between the ejection area 81 and the outer peripheral area 82*b*. The preventive plates 59 extend in the sub-scanning direction so as to connect between inside faces of the annular member 54 in the sub-scanning direction. That is, the preventive plates 59 are provided on the facing member 53 between the air outlet opening 30 and the ejection area 81 and between the air introduction opening 31 and the ejection area 81 in the main scanning direction. Since the ejection area 81 is enclosed with the preventive plates 59 and the annular member 54, it is possible to prevent the ink contacting the ejection area 81 from flowing into the air outlet opening 30 and the air introduction opening 31.

A length of each of the preventive plates 59 in the vertical direction is made shorter than that of the annular member 54 in the vertical direction (see FIG. 9). That is, a position of a distal end 59*a* of each of the preventive plates 59 is lower in height than that of the distal end 54*a* of the annular member 54. In the present embodiment, a pair of portions of the annular member 54 which extend in the main scanning direction and the pair of the preventive plates 59 each connecting between inside faces of the annular member 54 in the sub-scanning direction are one example of an annular enclosing member. It is noted that the preventive plates 59 are provided so as to extend from the facing member 53 in a direction directed from the facing member 53 toward the ejection face 10*a*, and the position of the distal end 59*a* of each of the preventive plates 59 is higher than that of the ejection area 81 in the vertical direction. In this construction, it is possible to prevent the ink contacting the ejection area 81 from flowing into the air outlet opening 30 and the air introduction opening 31.

A flow of a series of operations including the humidifying maintenance and the liquid removal maintenance in the printer 1 as the second embodiment is generally the same as that explained with reference to FIG. 8 in the first embodiment, other than that the processings in S6, S7, and S9 are omitted and that the ink contacting the ejection face 10*a* is removed by the wiper 9 in S8, and the ink removed from the area facing the ejection space A1 and the ink removed by the wiper 9 from the area of the head 10 which faces the ejection space A1 are sucked. Thus, an explanation of the flow in the second embodiment is omitted.

In the present embodiment, the preventive plates 59 and the annular member 54 prevent the ink discharged from the ejection openings 14*a* and contacting the ejection area 81, from flowing into the air outlet opening 30 and the air introduction opening 31. Further, since almost all the ink discharged from the ejection openings 14*a* remains in the ejection area 81, the liquid suction unit 70 can efficiently remove the ink in the ejection space A1.

It is noted that the annular enclosing member is constituted by the preventive plates 59 and the annular member 54 in the present embodiment, but the present invention is not limited to this configuration. That is, the annular enclosing member may be provided by any component(s) as long as the component(s) can enclose the ejection area 81 so as to prevent the ink contacting the ejection area 81 from flowing into the air outlet opening 30 and the air introduction opening 31 formed outside the ejection area 81.

<Third Embodiment>

Figure 10:
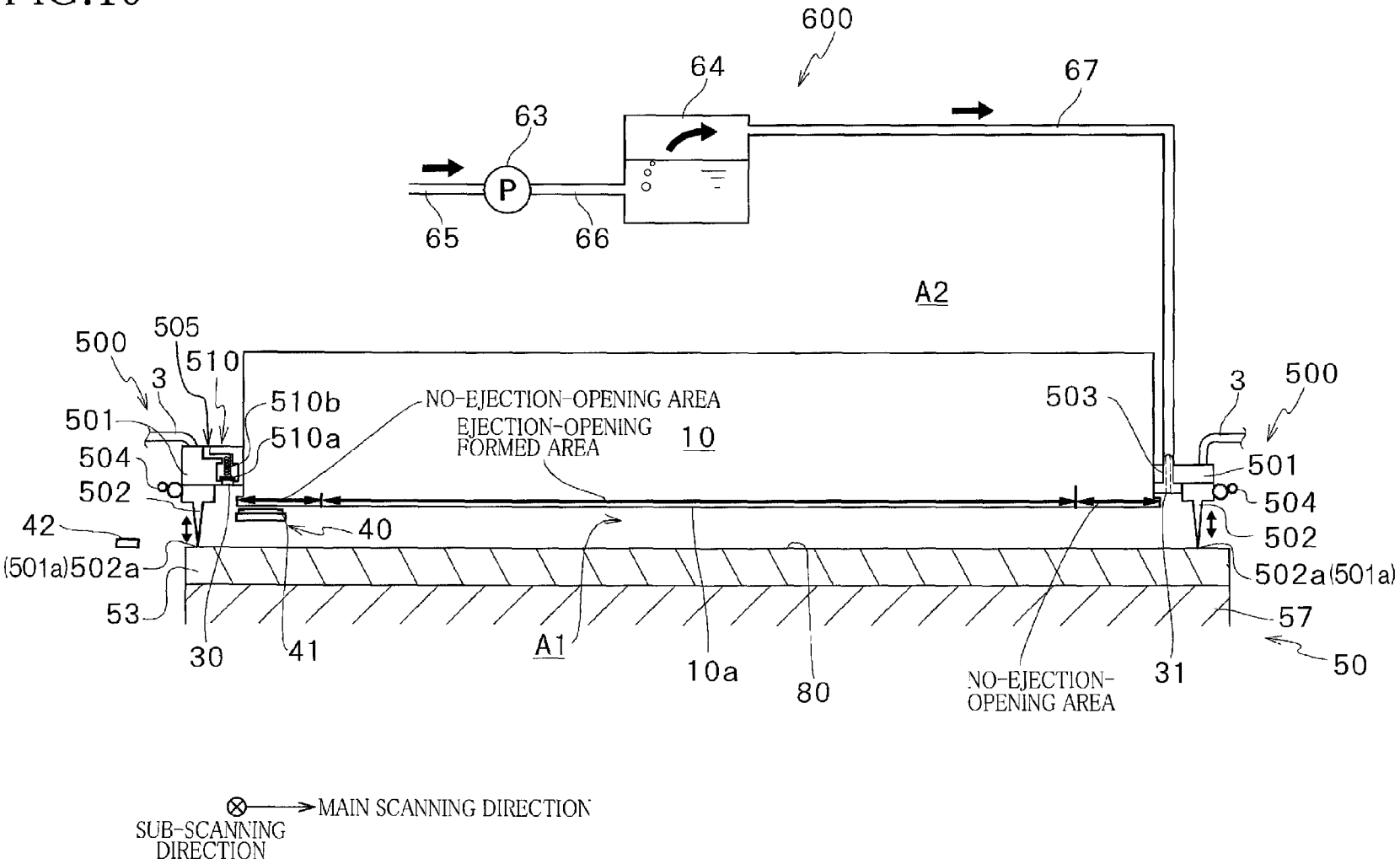
FIG. 10 is a schematic view, corresponding to FIG. 5, showing an ink-jet printer as a third embodiment of the present invention.
Figure 11:
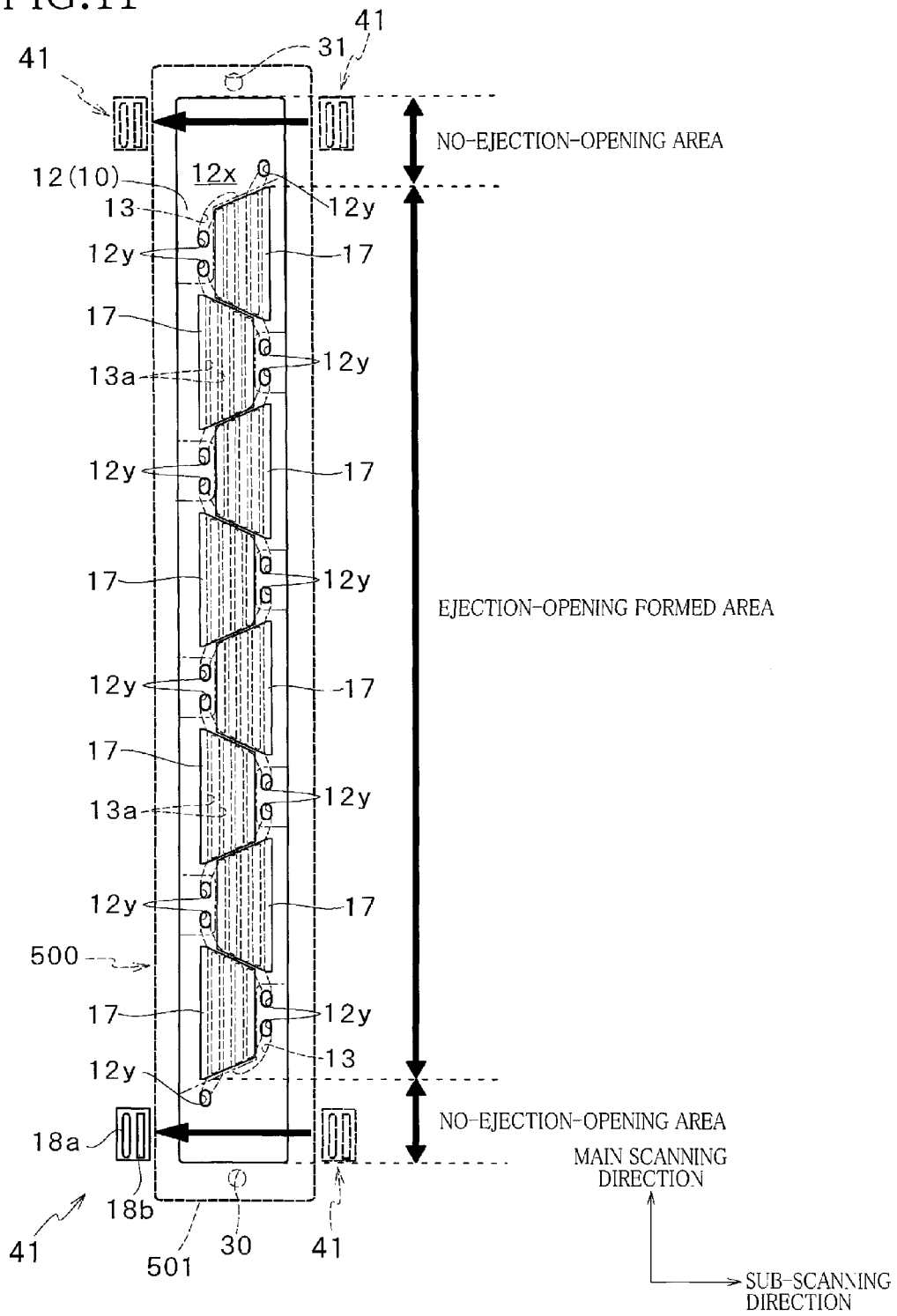
FIG. 11 is a view for explaining an ejection-face wiper of an ejection-space cleaning unit of the printer in FIG. 10.
Figure 12:
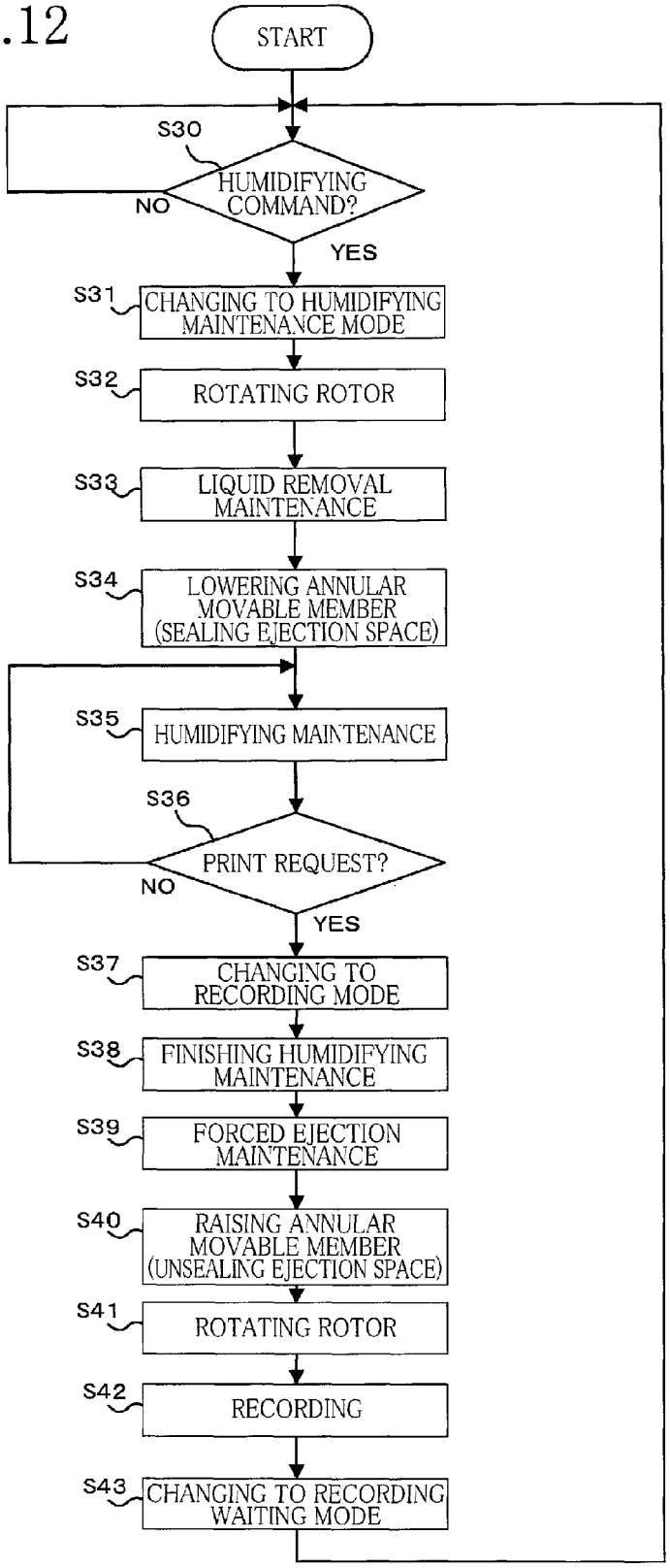
FIG. 12 is a flow-chart, corresponding to FIG. 8, showing a series of operations of the ink-jet printer as the third embodiment of the present invention.

There will be next explained a printer as a third embodiment of the present invention with reference to FIGS. 10-12. This third embodiment is different from the first embodiment in the sealing mechanism and the capping control section 135. Specifically, in the first embodiment, the capping control section 135 controls the recessed member 52 as the sealing mechanism to move upward and downward so as to selectively establish one of the sealing state and the open state, but in this third embodiment, the sealing mechanism selectively establishes one of the sealing state and the open state by upward and downward movement of an annular movable member 502 of a cap 500 provided on the head holder 3. Further, the air outlet opening 30 and the air introduction opening 31 are formed in the facing member 53 in the first embodiment but are formed in the cap 500 provided on the head holder 3 in this third embodiment.

Further, in the first embodiment, the cleaner is the liquid suction unit 70 configured to suck and remove the ink contacting the recessed member 52 at the area facing the ejection space A1, but in this third embodiment, the cleaner is an ejection-space cleaning unit 40 as one example of a head-liquid removal portion configured to wipe the ejection face 10*a* and the facing face 80 to remove the ink contacting the ejection face 10*a* of the head 10 at areas near the air outlet opening 30 and the air introduction opening 31 and the ink contacting the facing face 80. That is, the cleaning control section 138 controls the ejection-space cleaning unit 40. Further, in the first embodiment, the air is circulated between the humidification unit 60 and the ejection space A1, but in this third embodiment, the air is not circulated. That is, in this third embodiment, a humidification unit 600 only supplies the humid air into the ejection space A1. Further, in the first embodiment, only when the judging section 137 judges that the liquid removal maintenance is to be performed, the liquid removal maintenance is performed before the humidifying maintenance is performed, but in this third embodiment, the liquid removal maintenance is performed each time before the humidifying maintenance is performed. It is noted that the same reference numerals as used in the first embodiment are used to designate the corresponding elements of the third embodiment, and an explanation of which is dispensed with.

In the present embodiment, as shown in FIG. 10, only the facing member 53 (i.e., the recessed member 52 from which the annular member 54 is omitted) is fixed to the cap fixation member 57 instead of the recessed member 52 in the first embodiment. Further, in the present embodiment, the recessed portion 81*a* is not formed in the facing face 80 of the facing member 53, and the facing face 80 is flat.

There will be explained the cap 500 with reference to FIGS. 10 and 11. The cap 500 includes a fixed portion 501, the annular movable member 502, a joint 503, a gear 504, and a discharge tube 505.

The fixed portion 501 has an annular shape in plan view for enclosing an outer peripheral area of the ejection face 10*a* of the head 10 and is fixed to the head holder 3. The joint 503 is disposed on the fixed portion 501 at a position near one end of the head 10 in the main scanning direction, and the discharge tube 505 is disposed in the fixed portion 501 at a position near the other end of the head 10 in the main scanning direction. A lower face of the joint 503 is located above the ejection face 10*a* of the head 10, more specifically, is located above the ejection face 10*a* of the head 10 in the vertical direction. The air introduction opening 31 is formed in this lower face of the joint 503. An upper end of the discharge tube 505 is communicated with the outside space A2, a lower end thereof is communicated with the ejection space A1. A lower end of the discharge tube 505 is located above the ejection face 10*a* of the head 10, more specifically, is located above the ejection face 10*a* of the head 10. The air outlet opening 30 is formed in this lower end of the discharge tube 505. As thus described, the air outlet opening 30 and the air introduction opening 31 are formed in the fixed portion 501 fixed to the head holder 3, whereby a space is formed between (i) a position at which each of the air outlet opening 30 and the air introduction opening 31 is formed and (ii) the ejection area 81 of the facing member 53 which the liquid discharged from the ejection openings 14*a* contacts. This space prevents that the liquid or the ink contacting the ejection area 81 flow into the air outlet opening 30 and the air introduction opening 31 in the humidifying maintenance and clog the air outlet opening 30, the air introduction opening 31, and the tube 67. It is noted that each of the lower face of the joint 503 and the lower end of the discharge tube 505 may be positioned in the same plane as the ejection face 10*a* of the head 10.

An open/close valve 510 for opening/closing the air outlet opening 30 is provided in the discharge tube 505. The open/close valve 510 is constituted by a valve member 510*a* and a spring member 510*b* urging the valve member 510*a* downward. One end of the tube 65 of the humidification unit 600 is communicated with the outside space A2, and one end of the tube 67 is connected to an upper end of the joint 503.

When the air supply pump 63 of the humidification unit 600 is controlled and driven by the controller 100, an air in the outside space A2 is supplied into the tank 64 via the tubes 65, 66, and the air humidified in the tank 64 is supplied into the ejection space A1 via the air introduction opening 31. A pressure in the ejection space A1 is increased by the supply of the humid air into the ejection space A1 by the humidification unit 600. With the increase in the pressure in the ejection space A1, the valve member 510*a* of the open/close valve 510 is moved upward against an urging force of the spring member 510*b*, which opens the air outlet opening 30. As a result, the air in the ejection space A1 is discharged into the outside space A2 via the air outlet opening 30 and the discharge tube 505.

The annular movable member 502 is formed of an elastic material so as to have an annular shape in plan view for enclosing the outer peripheral area of the ejection face 10*a* of the head 10. A projecting portion 502*a* having an inverted triangle shape in cross section is formed on a lower end of the annular movable member 502. This annular movable member 502 can be moved upward and downward by driving of the gear 504. The annular movable member 502 can be moved so as to selectively establish one of (i) an upper position at which the projecting portion 502*a* is located on an upper side of the ejection face 10*a* and (ii) a lower position (see FIG. 10) at which the projecting portion 502*a* is located on a lower side of the ejection face 10*a*. The controller 100 controls the gear 504 such that the annular movable member 502 is positioned at the lower position when the operation mode stored in the operation-mode storage section 141 is the humidifying maintenance mode and such that the annular movable member 502 is positioned at the upper position when the operation mode is the mode other than the humidifying maintenance mode.

When the annular movable member 502 is located at the lower position, as shown in FIG. 10, a distal end 501*a* of the projecting portion 502*a* is held in contact with the outer peripheral area 82 of the facing face 80 to seal or isolate the ejection space A1 from the outside space A2. When the annular movable member 502 is located at the upper position, the distal end 501*a* of the projecting portion 502*a* is distant from the outer peripheral area 82 of the facing face 80, whereby the ejection space A1 is not isolated from the outside space A2. In the present embodiment, the cap 500 and the facing member 53 are one example of the sealing mechanism.

The ejection-space cleaning unit 40 includes an ejection-face wiper 41 and a facing-face wiper 42. In the present embodiment, opposite end portions of the ejection face 10*a* in the main scanning direction are called no-ejection-opening areas in each of which no ejection openings 14*a* are formed. The ejection-face wiper 41 wipes and removes the ink from these no-ejection-opening areas. The facing-face wiper 42 wipes the ink from the facing face 80.

As shown in FIG. 11, the ejection-face wiper 41 includes: a sponge-like cleaning-liquid applying portion 18*a* for retaining the cleaning liquid supplied from a cleaning-liquid tank, not shown; and a rectangular blade 18*b* formed of an elastic material such as rubber and resin. The ejection-face wiper 41 can be moved by a moving mechanism, not shown, in three directions, namely, an up and down direction, the main scanning direction, and the sub-scanning direction. A length of the ejection-face wiper 41 in the main scanning direction is made equal to or less than that of each of the no-ejection-opening areas of the ejection face 10*a* in the main scanning direction.

The facing-face wiper 42 is movable in the main scanning direction under the control of the controller 100. A wait position of the facing-face wiper 42 is located on a left side of the facing member 53 in a sheet face of FIG. 10. The facing-face wiper 42 is a plate-like member formed of an elastic material such as rubber and extending in the sub-scanning direction. It is noted that operations of the ejection-face wiper 41 and the facing-face wiper 42 will be described below in detail.

There will be next explained a flow of a series of operations including the humidifying maintenance and the liquid removal maintenance in the printer 1 as the third embodiment with reference to FIG. 12.

Processings in S30-S32 are generally the same as those in S1-S3 in the first embodiment explained with reference to FIG. 8, and an explanation thereof is omitted.

In S33, the cleaning control section 138 controls the ejection-face wiper 41 to wipe the ink from the no-ejection-opening areas of the ejection face 10*a*. Specifically, the cleaning control section 138 initially moves the ejection-face wiper 41 to one side of one of the no-ejection-opening areas of the ejection face 10*a* in the sub-scanning direction. It is noted that the cleaning-liquid applying portion 18*a* is located nearer to the ejection face 10*a* than the blade 18*b* in this state. Further, one end of the ejection-face wiper 41 in the main scanning direction and one end of the ejection face 10*a* in the main scanning direction coincide with each other in the sub-scanning direction. The cleaning control section 138 then controls the ejection-face wiper 41 to move upward such that distal ends of the cleaning-liquid applying portion 18*a* and the blade 18*b* become equal to or slightly greater than the ejection face 10*a* in height. The cleaning control section 138 then controls the ejection-face wiper 41 to move across the no-ejection-opening area of the ejection face 10*a* in the sub-scanning direction or leftward in FIG. 11. As the ejection-face wiper 41 is moved, the cleaning-liquid applying portion 18*a* applies the cleaning liquid to the ejection face 10*a*, and the blade 18*b* removes the cleaning liquid applied by the cleaning-liquid applying portion 18*a*. As a result, the ink contacting the no-ejection-opening area of the ejection face 10*a* is removed. When the removal of the ink from the one of the no-ejection-opening areas is finished, the ink removal or cleaning is performed for the other of the no-ejection-opening areas in the same manner after the ejection-face wiper 41 is lowered.

Further, in S33, the cleaning control section 138 controls the facing-face wiper 42 to wipe the ink from the facing face 80. Specifically, the cleaning control section 138 controls the facing-face wiper 42 to move in the main scanning direction while bending and contacting the facing-face wiper 42 in a state in which a distal end of the facing-face wiper 42 faces downward. As a result, the ink contacting the facing face 80 is removed.

In S33, the ink contacting the no-ejection-opening areas of the ejection face 10*a* as vicinity areas of the air outlet opening 30 and the air introduction opening 31 and the ink contacting the facing face 80 are removed. As a result, the ejection space A1 can be speedily humidified in the humidifying maintenance to be performed later. Further, it is possible to prevent that the ink flows into the air outlet opening 30 and the air introduction opening 31 and clogs the air outlet opening 30, the air introduction opening 31, and the tube 67.

Then in S34, the capping control section 135 drives the gear 504 to move the annular movable member 502 from the upper position to the lower position. As a result, since the projecting portion 502*a* of the annular movable member 502 is held in contact with the facing face 80, the ejection space A1 facing the ejection face 10*a* is sealed or isolated from the outside space A2.

Then in S35, the humidifying maintenance is performed in which the air-supply-pump control section 136 drives the air supply pump 63 to supply the humid air into the ejection space A1.

Processings in S36-S39 are generally the same as those in S11-S14 explained with reference to FIG. 8, and an explanation thereof is omitted. In S40, the capping control section 135 drives the gear 504 to move the annular movable member 502 from the lower position to the upper position. As a result, the projecting portion 502*a* of the annular movable member 502 comes off the facing face 80, so that the ejection space A1 facing the ejection face 10*a* is not sealed or isolated from the outside space A2. Processings in S41-S43 are generally the same as those in S16-S18 explained with reference to FIG. 8, and an explanation thereof is omitted.

In this third embodiment, since the space is formed between (i) the position at which each of the air outlet opening 30 and the air introduction opening 31 is formed and (ii) the ejection area 81 of the facing member 53 which the ink discharged from the ejection openings 14*a* contacts, it is possible to prevent that the ink contacting the ejection area 81 flows into the air outlet opening 30 and the air introduction opening 31 in the humidifying maintenance and clogs the air outlet opening 30, the air introduction opening 31, and the tube 67. Further, before the humidifying maintenance is performed, the ejection-face wiper 41 removes the ink contacting the no-ejection-opening areas of the ejection face 10*a* as the vicinity areas of the air outlet opening 30 and the air introduction opening 31, and the facing-face wiper 42 removes the ink contacting the facing face 80. This makes it possible to speedily humidify the ejection space A1 in the humidifying maintenance and to prevent that the ink flows into the air outlet opening 30 and the air introduction opening 31 and clogs the air outlet opening 30, the air introduction opening 31, and the tube 67.

It is noted that, in the third embodiment, the ejection-face wiper 41 is configured to remove only the ink contacting the no-ejection-opening areas of the ejection face 10*a* but may be configured to remove the ink contacting an entirety of the ejection face 10*a* including the ejection-opening formed area. Further, the ejection-face wiper 41 may be configured to also remove the ink contacting the fixed portion 501 and the joint 503 of the cap 500. Further, the ejection-face wiper 41 may not include the cleaning-liquid applying portion 18*a*, that is, the ejection-face wiper 41 may not apply the cleaning liquid.

In the third embodiment, the printer has the air outlet opening 30, the discharge tube 505, and the open/close valve 510 for discharging the air in the ejection space A1 to the outside space A2, but these components may be omitted. In this configuration, when the ejection space A1 is sealed and isolated from the outside space A2, the projecting portion 502*a* of the annular movable member 502 is held in loose contact with the facing face 80, whereby the air in the ejection space A1 can be discharged to the outside space A2 through the contact area, with the increase in the pressure in the ejection space A1.

While the embodiments of the present invention have been described above, it is to be understood that the invention is not limited to the details of the illustrated embodiments, but may be embodied with various changes and modifications, which may occur to those skilled in the art, without departing from the spirit and scope of the invention. For example, in each of the above-described embodiments, the humidification unit 60 includes the air supply pump 63 and the tank 64, but any components or mechanism may be used as long as the air can be humidified. For example, the printer may be configured such that the humidification is performed only by the tank 64 without providing the air supply pump 63. Further, the humidification may be performed by further using a heating means such as a heater, by using an ultrasound humidifying means, or by disposing a wet porous material such as a wet sponge or a wet cloth in the air channel (the circulation channel).

In each of the above-described embodiments, the humid air supplier is configured to humidify the air by the tank 64 and supply the humidified air into the ejection space A1, but the humid air supplier may not have the function of humidifying the air but only have a function of supplying the humid air stored in a container such as a tank into the ejection space.

The cleaner is not limited to having the above-described configuration but may have any configuration as long as the cleaner can remove or clean the ink contacting the head 10 and the sealing mechanism at their areas facing the ejection space A1. Further, the cleaner may be configured to also clean the ink contacting the head 10 and the sealing mechanism at their areas not facing the ejection space A1 as long as the cleaner can remove the ink contacting the head 10 and the sealing mechanism at their areas facing the ejection space A1.

In the above-described embodiments, the cleaning control section 138 drives the suction pump 77 to discharge the ink contacting the ejection area 81 of the facing member 53 to the waste-ink tank 78 to perform the liquid removal maintenance in the state in which the ejection space A1 facing the ejection face 10*a* is sealed or isolated from the outside space A2. However, the liquid removal maintenance may be performed in the state in which the ejection space A1 facing the ejection face 10*a* is not sealed or isolated from the outside space A2.

It is noted that, in the above-described first and second embodiments, when the mode change section 131 changes the operation mode stored in the operation-mode storage section 141 from the recording mode to the humidifying maintenance mode, the rotor-rotation control section 134 rotates the rotor 58 so as to change the rotor 58 from the first rotation state to the second rotation state, but the capping control section 135 may control the rotor raising and lowering mechanism 56 to lower the rotor 58 by an appropriate distance before the rotation of the rotor 58 in order to avoid a collision between the ejection face 10*a* and the platen 51 or the recessed member 52 during the rotation of the rotor 58.

In the above-described first and second embodiments, when the operation mode is changed from the recording mode to the humidifying maintenance mode, not the support-cap unit 50 including the rotor 58 but the platen 51 may be lowered to move the recessed member 52 in the main scanning direction to a position between the platen 51 and the ejection face 10*a*, and then the distal end 54*a* of the annular member 54 of the recessed member 52 may be brought into contact with the ejection face 10*a*.

In the above-described first and second embodiments, only when the judging section 137 judges that the liquid removal maintenance is to be performed, the liquid removal maintenance is performed before the humidifying maintenance is performed, but the liquid removal maintenance may be performed each time before the humidifying maintenance is performed. Further, in the third embodiment, the liquid removal maintenance is performed each time before the humidifying maintenance is performed, but, like the first and second embodiments, the liquid removal maintenance may be performed before the humidifying maintenance is performed only when the judging section 137 judges that the liquid removal maintenance is to be performed.

It is noted that, in the above-described first and second embodiments, even when the rotor 58 is rotated, the air supply pump 63 and the tank 64 of the humidification unit 60 and the suction pump 77 and the waste-ink tank 78 of the liquid suction unit 70 are not turned over (that is, each of these components is maintained in the same posture).

In the above-described embodiments, the humidification-command input section 133 is configured to input or transmit the humidifying command to the mode change section 131 when the user inputs the forcible humidification command using the touch panel 90 or when the print request is not received until the predetermined length of time passes after the image recording based on the print request is finished, but the present invention is not limited to this configuration. That is, the humidification-command input section 133 has only to be configured to input the humidifying command to the mode change section 131 when the humidification is required.

In the above-described embodiments, the liquid removal maintenance is performed after the mode change section 131 receives the humidifying command and before the humid air supplier performs the humidifying maintenance but may be performed before the mode change section 131 receives the humidifying command. Further, the humidifying maintenance is performed by the humid air supplier successively after the cleaner cleans the liquid, but these operations do not need to be performed successively. That is, any configuration may be employed as long as the amount of the ink in the ejection space A1 is reduced by the cleaner before the humid air supplier performs the humidifying maintenance. As thus described, the printer 1 according to the present invention is configured such that the amount of the ink in the ejection space A1 is reduced by the cleaner, making it possible to suppress the lowering of the functionality of the humidification when compared with a configuration in which the printer 1 does not include the cleaner.

In the above-described embodiments, the forced-ejection control section 139 controls the purging mechanism 8 after receiving the print request to perform the forced ejection maintenance in which the ink is purged or flushed from the head 10 toward the ejection area 81 of the facing face 80, but the forced ejection maintenance does not need to be performed as long as the viscosity of the ink in the ejection openings 14*a* is maintained at a proper value by the humidifying maintenance. Further, the printer 1 may not be configured such that the ink is purged or flushed from the head 10 toward the ejection area 81 of the facing face 80 in the forced ejection maintenance. For example, the printer 1 may be configured such that the ink is purged or flushed toward an ink receiver additionally provided or such that the ink is flushed toward an edge portion of the sheet P.

The present invention is applicable not only to the monochrome printer but also to a color printer. The present invention is applicable to any of the line printer and a serial printer. Further, the present invention is applicable not only to the printer but also to devices such as a facsimile machine and a copying machine. The head may eject any liquid other than the ink for recording an image on the recording medium. For example, the head may eject treatment liquid containing components for coagulating or precipitating components of the ink for improving an image quality. The recording apparatus may include more than one head. The recording medium is not limited to the sheet P and may be various types of recordable media.

In the above-described embodiments, the single CPU of the controller 100 executes all the processings. However, the present invention is not limited to this configuration. For example, the controller 100 may use a plurality of CPUs, an application-specific integrated circuit (ASIC), or a combination of the CPU(s) and the ASIC to execute the processings explained above.

What is claimed is:

1. A liquid ejection apparatus, comprising:

a liquid ejection head having an ejection face that has at least one ejection opening through which the liquid ejection head ejects liquid for forming an image on a recording medium;

a sealing mechanism comprising an ejection area facing the ejection face so as to define an ejection space between the ejection area and the ejection face, the sealing mechanism being configured to selectively establish:

a sealing state in which the sealing mechanism seals the ejection space from an outside space, and an open state in which the sealing mechanism does not seal the ejection space from the outside space;

an air introduction opening configured to open in an area that faces the ejection space when the sealing mechanism is in the sealing state;

a humid air supplier configured to supply a humid air from the air introduction opening to the ejection space in the sealing state;

a cleaner configured to clean the liquid contacting at least a part of an area of the liquid ejection head and the sealing mechanism, the area facing the ejection space; and a controller configured to:

control the cleaner to start a cleaning operation in response to receiving a humidifying command;

control the humid air supplier to start a humidifying operation after completion of the cleaning operation;

control the liquid ejection head to start a flushing operation in response to receiving a recording command after a start of the humidifying operation; and control the liquid ejection head to start a recording operation after a completion of the flushing operation.

2. The liquid ejection apparatus according to claim 1, wherein the controller is configured to perform the cleaning operation in the sealing state, and is further configured to perform the humidifying operation in a state in which the sealing state of the sealing mechanism is continued.

3. The liquid ejection apparatus according to claim 2, further comprising a humidification-command input section configured to input the humidifying command to the controller.

4. The liquid ejection apparatus according to claim 1, wherein the controller is further configured to judge whether the cleaning operation by the cleaner is required before the humidifying operation and, when it is judged that the cleaning operation is not required before the humidifying operation, to perform the humidifying operation without performing the cleaning operation.

5. The liquid ejection apparatus according to claim 4, wherein the controller is configured to perform the judgment based on a length of time elapsed from a previous cleaning operation by the cleaner.

6. The liquid ejection apparatus according to claim 1, further comprising:

an air outlet opening configured to open in a peripheral area around the ejection area that faces the ejection face when the sealing mechanism is in the sealing state; and a circulation channel having one end and the other end communicated with the air introduction opening and the air outlet opening, respectively, wherein the humid air supplier is disposed on the circulation channel and configured to humidify the air which is collected from the ejection space through the air outlet opening and the circulation channel and to supply the humidified air from the air introduction opening into the ejection space through the circulation channel.

7. The liquid ejection apparatus according to claim 1, further comprising:

an air outlet opening configured to open in a peripheral area around the ejection area that faces the ejection face when the sealing mechanism is in the sealing state, wherein the humid air supplier is configured, in addition to performing the supply, to discharge the air in the ejection space to an outside of the ejection space via the air outlet opening.

8. The liquid ejection apparatus according to claim 7, wherein the cleaner includes a liquid removal portion configured to remove the liquid discharged onto the ejection area so as to discharge the liquid to the outside of the ejection space via a liquid suction opening formed in the ejection area.

9. The liquid ejection apparatus according to claim 8, wherein the liquid removal portion includes a cleaning liquid supplier configured to supply cleaning liquid to the ejection space, wherein the controller is configured to change the sealing mechanism to the sealing state, then control the cleaning liquid supplier to supply the cleaning liquid into the ejection space, and then control the liquid removal portion to perform the removal, and wherein the controller is configured to close the liquid suction opening when the cleaning liquid is supplied into the ejection space.

10. The liquid ejection apparatus according to claim 8, wherein the air outlet opening and the air introduction opening are formed in the peripheral area, wherein a recessed portion is provided in the ejection area, and wherein the liquid suction opening is formed in the recessed portion at a position lower than the air outlet opening and the air introduction opening in a vertical direction.

11. The liquid ejection apparatus according to claim 6, wherein the air outlet opening is formed in the peripheral area, and wherein a preventive member is provided between the ejection area and the peripheral area for preventing the liquid ejected on the ejection area from flowing into the air outlet opening.

12. The liquid ejection apparatus according to claim 11, further comprising an annular enclosing member including the preventive member and configured to enclose the ejection area, wherein the air outlet opening is formed in the peripheral area at a position outside the annular enclosing member.

13. The liquid ejection apparatus according to claim 11, wherein the cleaner includes a liquid removal portion configured to remove the liquid present on the ejection area so as to discharge the liquid to the outside of the ejection space via a liquid suction opening formed in the ejection area.

14. The liquid ejection apparatus according to claim 11, wherein the air introduction opening is formed in the peripheral area at a position outside the preventive member.

15. The liquid ejection apparatus according to claim 8, wherein the sealing mechanism includes a recessed member constituted by the ejection area and an annular member that extends from the ejection area and has a distal end which is held in contact with the ejection face in the sealing state.

16. The liquid ejection apparatus according to claim 6, wherein the air outlet opening and the air introduction opening are formed in the sealing mechanism at positions located on the same plane as the ejection face of the liquid ejection head or at positions greater in height than the same plane in a vertical direction, and wherein the cleaner includes a head-liquid removal portion configured to remove the liquid contacting the liquid ejection head at the area facing the ejection area.

17. The liquid ejection apparatus according to claim 1, wherein the air introduction opening and the air outlet opening are closed during the cleaning operation.

* * * * *